US012370645B2

(12) United States Patent
Esenwein

(10) Patent No.: US 12,370,645 B2
(45) Date of Patent: Jul. 29, 2025

(54) HAND-HELD GRINDING MACHINE

(71) Applicant: Robert Bosch GmbH, Stuttgart (DE)

(72) Inventor: Florian Esenwein, Leinfelden-Echterdingen (DE)

(73) Assignee: Robert Bosch GmbH, Stuttgart (DE)

( * ) Notice: Subject to any disclaimer, the term of this patent is extended or adjusted under 35 U.S.C. 154(b) by 313 days.

(21) Appl. No.: 17/451,358

(22) Filed: Oct. 19, 2021

(65) Prior Publication Data

US 2022/0118579 A1 Apr. 21, 2022

(30) Foreign Application Priority Data

Oct. 20, 2020 (DE) ..... 10 2020 213 231.3

(51) Int. Cl.
*B24B 23/02* (2006.01)
*B24B 23/00* (2006.01)

(52) U.S. Cl.
CPC ..... *B24B 23/02* (2013.01); *B24B 23/005* (2013.01)

(58) Field of Classification Search
CPC ..... B24B 23/005; B24B 23/02; B24B 23/028; B24B 55/10; B24B 55/102; B24B 55/052; B24B 55/05; B24B 23/04; B24B 23/00
See application file for complete search history.

(56) References Cited

U.S. PATENT DOCUMENTS

| | | | | |
|---|---|---|---|---|
| 5,518,442 | A * | 5/1996 | Clowers | B24B 23/03 451/357 |
| 7,771,253 | B2 * | 8/2010 | Wuensch | B24B 23/04 451/344 |
| 8,926,409 | B2 * | 1/2015 | Nordstrom | B25F 5/02 451/344 |
| 2013/0165027 | A1 * | 6/2013 | Sugita | B25F 5/02 451/344 |
| 2016/0121475 | A1 * | 5/2016 | Valentini | B24B 23/005 451/344 |
| 2019/0030616 | A1 * | 1/2019 | Hess | B23B 31/10 |

* cited by examiner

*Primary Examiner* — Eric J Rosen
*Assistant Examiner* — John C Merino
(74) *Attorney, Agent, or Firm* — Maginot, Moore & Beck LLP

(57) ABSTRACT

A hand-held grinding machine includes at least one grinding device for receiving or forming a grinding means, a drive device for driving the grinding device, at least one actuating element for controlling the drive device, and a drive housing, which receives the drive device and has a longitudinal-axis portion arranged about a longitudinal axis at least substantially perpendicular to an axis of rotation of the drive device. The drive housing further includes a front portion, which surrounds a region of an intersection point of the axis of rotation and the longitudinal axis. The front portion includes a dome-shaped grip surface, within which the actuating element is arranged on a side, facing away from the longitudinal-axis portion, of a plane which is perpendicular to the longitudinal axis and includes the axis of rotation.

19 Claims, 14 Drawing Sheets

HAND-HELD GRINDING MACHINE

This application claims priority under 35 U.S.C. § 119 to application no. DE 10 2020 213 231.3, filed on Oct. 20, 2020 in Germany, the disclosure of which is incorporated herein by reference in its entirety.

BACKGROUND

A hand-held grinding machine having at least one grinding device for receiving or forming a grinding means, having a drive device for driving the grinding device, having at least one actuating element for controlling the drive device and having a drive housing, which receives the drive device and has a longitudinal-axis portion arranged about a longitudinal axis at least substantially perpendicular to an axis of rotation of the drive device and which comprises a front portion, which surrounds a region of an intersection point of the axis of rotation and the longitudinal axis, has already been proposed.

SUMMARY

The disclosure proceeds from a hand-held grinding machine having at least one grinding device for receiving or forming a grinding means, having a drive device for driving the grinding device, having at least one actuating element for controlling the drive device and having a drive housing, which receives the drive device and has a longitudinal-axis portion arranged about a longitudinal axis which is at least substantially perpendicular to an axis of rotation of the drive device, and comprises a front portion, which surrounds a region of an intersection point of the axis of rotation and the longitudinal axis.

It is proposed that the front portion comprises a dome-shaped grip surface, within which the actuating element is arranged on a side, facing away from the longitudinal-axis portion, of a plane which is perpendicular to the longitudinal axis and comprises the axis of rotation. The hand-held grinding machine can preferably be held by a hand, in particular without a transporting and/or holding device, and can be guided and operated in particular with the same hand during a grinding operation. The hand-held grinding machine may be in the form of an eccentric grinder, a forcibly driven eccentric grinder, an oscillating grinder, a triangular grinder, a polisher, or the like. The grinding means may be in the form for example of abrasive paper, a grinding sponge pad, a non-woven grinding fabric, a grinding cloth, a polishing sponge pad, a scrubbing wheel, a buffing wheel, or the like. In particular, the grinding device comprises at least one grinding pad having a planar basic area, which is in particular at least substantially perpendicular to the axis of rotation and is provided for fastening the grinding means. "Provided" is to be understood to mean in particular specially configured, specially programmed, specially designed and/or specially equipped. An object being provided for a particular function should be understood in particular to mean that the object fulfils and/or carries out this particular function in at least one use state and/or operating state. The expression "substantially perpendicular" should be understood here in particular to mean an alignment of a direction relative to a reference direction, wherein the direction and the reference direction, in particular as viewed in a projection plane, forms an angle of 90° and the angle has a maximum deviation of in particular less than 8°, advantageously less than 5° and especially advantageously less than 2°.

The drive device preferably comprises an electric motor, in particular a brushless DC motor, for driving a drive shaft of the drive device about the axis of rotation common to the electric motor and the drive shaft. The grinding device is preferably arranged directly or indirectly on the drive shaft in order to drive the grinding pad. The drive device comprises in particular control electronics for the open-loop or closed-loop control of the electric motor. The drive device preferably comprises at least one electrical power supply interface for supplying energy to the electric motor. The electrical power supply interface is particularly preferably designed for receiving a battery which can be detached nondestructively from the drive device and/or a rechargeable battery, in particular a rechargeable battery pack, which can be detached nondestructively. As an alternative or in addition, the electrical power supply interface comprises a line-bound, inductive or capacitive charging element for supplying power to an internal energy store of the drive device. The actuating element is provided in particular for activating or deactivating the drive device. The actuating element is preferably in the form of a switch, which can be arrested in an activated state of the drive device. As an alternative, the actuating element is in the form of a push-button.

A maximum longitudinal extent of the drive housing in the direction of the longitudinal axis is preferably greater than a maximum extent of the drive housing in the direction of the axis of rotation. The maximum extent of the drive housing in the direction of the axis of rotation is referred to below as overall height of the drive housing for differentiation purposes. The hand-held grinding machine optionally comprises a connecting housing unit, in which the grinding device is at least partially arranged. The connecting housing unit is formed in particular in dependence on a design of the grinding device. The overall height of the drive housing refers in particular to a housing part of the hand-held grinding machine, which housing part is independent of the specific configuration of the grinding device and in particular does not take into account the connecting housing unit of the grinding device. In the case of a unipartite configuration of the drive housing with the connecting housing unit of the grinding device, a separating plane, which is perpendicular to the axis of rotation and from which the overall height is measured, is defined between the drive housing and the connecting housing unit by an end, facing the grinding device, of the drive shaft. The electrical power supply interface and/or the control electronics are/is preferably arranged in the longitudinal-axis portion of the drive housing. The electric motor and the drive shaft are preferably arranged in the front portion. The grinding device is arranged in particular at the front portion in the direction of the axis of rotation. A maximum extent of a cross section of the longitudinal-axis portion perpendicular to the longitudinal axis is preferably smaller than the overall height of the drive housing parallel to the axis of rotation, in particular such that the longitudinal-axis portion, the front portion and grinding device form an L-shaped structure, in particular in an assembly plane. The assembly plane is spanned in particular by the longitudinal axis and by the axis of rotation. The drive housing preferably comprises two drive-housing half shells, which are arranged against one another in the assembly plane and form in particular half of the longitudinal-axis portion and the front portion in each case. The front portion is preferably materially bonded to the longitudinal-axis portion, in particular is produced from a casting or in a pressing process. The drive housing is particularly preferably produced by an injection moulding process, in particular a single-component and/or multi-component injection moulding process, or by a die-casting process.

The dome-shaped grip surface has in particular a surface which is convexly domed with respect to the axis of rotation and/or the longitudinal axis. The dome-shaped grip surface has an elliptical outer contour in particular on sides facing away from the grinding device and/or the longitudinal-axis portion. In particular, the dome-shaped grip surface has an outer contour in the assembly plane that is oval-shaped in sections and/or in portions. The dome-shaped grip surface preferably has a further outer contour in a plane which is perpendicular to the axis of rotation that is oval-shaped in sections and/or in portions. The dome-shaped grip surface preferably has an additional outer contour in a plane which is perpendicular to the longitudinal axis that is oval-shaped in sections and/or in portions. In particular, in a plane which is perpendicular to the longitudinal axis, the dome-shaped grip surface has a larger maximum transverse extent than a maximum transverse extent, parallel thereto, of the longitudinal-axis portion. In particular, in a plane which is perpendicular to the longitudinal axis, the dome-shaped grip surface has two maximum transverse extents, perpendicular to one another, both of which are larger than a maximum transverse extent, parallel thereto in each case, of the longitudinal-axis portion. An outer contour of the longitudinal-axis portion in a projection along the longitudinal axis is particularly preferably completely inside the outer contour of the front portion. In particular, the dome-shaped grip surface is provided for a hand to engage around it. In particular, the grip surface establishes the region provided for a hand to engage around. The grip surface is optionally formed from a soft component, which is materially bonded to the drive-housing half-shells by means of a multi-component injection molding process, for example, or which is formed separately and is fastened to the drive-housing half-shells by means of latching projections, for example. In particular, the grip surface is arranged on an outer side of the drive-housing half-shells. As an alternative, the grip surface is formed by a surface of the drive-housing half-shells.

In particular, the grip surface extends in a plane which is perpendicular to the longitudinal axis, and in particular encompasses the axis of rotation, with respect to an intersection point of the axis of rotation and the longitudinal axis by an angular range of more than 180°, preferably more than 220°, particularly preferably by more than 250° about the intersection point, in particular on an outer side of the drive-housing half-shells. The grip surface preferably extends over at least 50%, preferably more than 60%, preferably more than 75% of an outer contour of the drive-housing half-shells in the plane which is perpendicular to the longitudinal axis and in particular encompasses the axis of rotation. In particular, the grip surface extends in a plane which is perpendicular to the axis of rotation, and in particular encompasses the axis of rotation, with respect to the intersection point of the axis of rotation and the longitudinal axis by an angular range of more than 120°, preferably more than 160°, particularly preferably by more than 180° about the intersection point, in particular on an outer side of the drive-housing half-shells. The grip surface preferably extends over at least 10%, preferably more than 20%, of an outer contour of the drive-housing half-shells in the plane which is perpendicular to the axis of rotation and in particular encompasses the axis of rotation. The grip surface preferably extends over less than 75%, preferably less than 50%, of an outer contour of the drive-housing half-shells in the plane which is perpendicular to the axis of rotation and in particular encompasses the axis of rotation. In particular, the grip surface extends in an assembly plane with respect to the intersection point of the axis of rotation and the longitudinal axis by an angular range of more than 160°, preferably more than 180°, particularly preferably by more than 200° about the intersection point, in particular on an outer side of the drive-housing half-shells. The grip surface preferably extends over at least 10%, preferably more than 20%, particularly preferably over more than 30%, of an outer contour of the drive-housing half-shells in the assembly plane. The grip surface preferably extends over less than 80%, preferably less than 60%, of an outer contour of the drive-housing half-shells in the assembly plane. A plane which is perpendicular to the longitudinal axis and intersects neither the actuating element nor the electric motor, in particular at least does not intersect a stator coil or magnet of the electric motor, can preferably be arranged between the actuating element and the electric motor. The assembly plane preferably intersects the actuating element, in particular in the center. The assembly plane particularly preferably is a plane of mirror symmetry for the actuating element.

The configuration according to the disclosure makes it possible to provide an advantageously ergonomic hand-held grinding machine. In particular, it is possible to achieve an advantageously secure guidance of the hand-held grinding machine by engaging a hand around the front portion. In particular, the dome-shaped configuration of the hand-held grinding machine makes it possible for it to be held securely by a hand with an advantageously small force. In particular, the actuating element can advantageously be actuated without engaging the index finger and/or middle finger around it and in particular without the aid of a second hand. In particular, physical loading resulting from a grinding operation carried out by the hand-held grinding machine can advantageously be kept small. In particular, a risk of injury arising from in particular sustained and/or frequent use of the hand-held grinding machine can advantageously be kept low.

It is also proposed that the actuating element is arranged, in particular recessed, in a partial surface area of the grip surface, which partial surface area is arranged obliquely to the longitudinal axis and to the axis of rotation. The partial surface area in which the actuating element is arranged is preferably arranged on a side, facing away from the grinding device, of the drive housing. The grip surface preferably has a flattened form around the actuating element. In particular, the partial surface area surrounding the actuating element runs in a planar manner at least in sections in the assembly plane. In particular, the partial surface area in which the actuating element is arranged has an angle of between 35° and 50°, particularly preferably between 40° and 45°, to the longitudinal axis in the assembly plane. In an activated state of the hand-held grinding machine, the actuating element is preferably arranged flush with the partial surface area surrounding the actuating element or arranged set back with respect to said partial surface area into an interior space of the front portion. A curvature of the actuating element in a plane which is perpendicular to the axis of rotation is preferably matched to a curvature of the grip surface in this plane. The actuating element preferably takes up less than half of a maximum extent of the partial surface area surrounding the actuating element in a direction which is perpendicular to the axis of rotation and to the longitudinal axis. The actuating element preferably takes up less than half, preferably less than a quarter, of a maximum grip-surface longitudinal extent of the grip surface parallel to the longitudinal axis. A machine termination plane which is parallel to the axis of rotation and comprises that point of the drive housing which is spaced apart the furthermost from the grinding pad is preferably arranged spaced apart from the actuating element. The configuration according to the disclosure makes it possible for the actuating element to be actuated advantageously with a single finger, in particular without having to release the engagement of the hand around the grip surface. An advantageously high level of work safety can be achieved.

It is also proposed that partial surface areas, terminating the front portion along the longitudinal axis, of the grip surface, one of which surrounds the actuating element, are arranged at a front angle of between 95° and 110° in relation to one another. The front angle particularly preferably amounts to between 98° and 102°. The front angle is in particular in the assembly plane. The partial surface areas comprising the front angle preferably lie on different sides of a plane which is perpendicular to the axis of rotation. That one of the partial surface areas which does not comprise the actuating element is arranged in particular facing the grinding device and has an angle of between 30° and 55°, preferably between 45° and 50°, to the longitudinal axis in the assembly plane. A transition between the partial surface areas which terminate the front portion along the longitudinal axis in particular has a rounded form. It is preferably the case that most of, in particular more than 50%, particularly preferably more than 75%, of a volume of the electric motor is arranged on a side of the transverse plane that faces the grinding device. The configuration according to the disclosure makes it possible to hold the grip surface securely, advantageously without strong curving of the finger. In particular, a risk of cramping of the finger owing to a relatively long grinding process can advantageously be kept low.

It is also proposed that the actuating element and the grinding device are arranged on different sides of a transverse plane, in particular the already mentioned transverse plane, which is at least substantially perpendicular to the axis of rotation and in which the front portion has the greatest grip-surface transverse extent, which runs at least substantially perpendicularly to the axis of rotation and at least substantially perpendicularly to the longitudinal axis. In particular, the greatest grip-surface transverse extent is the greatest transverse extent of the entire drive housing perpendicular to the longitudinal axis and to the axis of rotation. In particular, a ratio of the greatest grip-surface transverse extent to an overall height of the drive housing, in particular without the connecting housing unit, amounts to between 0.75 and 1, preferably between 0.8 and 0.95, particularly preferably between 0.85 and 0.9. In particular, the greatest grip-surface transverse extent is between 65 mm and 85 mm, preferably between 70 mm and 80 mm, particularly preferably between 72 mm and 76 mm. The configuration according to the disclosure makes it possible to advantageously intuitively impart an intended ergonomic handhold for the purpose of forming a form fit with the hand-held grinding machine and a secure guidance of the hand-held grinding machine, in that in particular an advantageously natural handhold with the thumb and index finger on different sides of the transverse plane is supported.

It is furthermore proposed that a ratio of a maximum grip-surface height, parallel to the axis of rotation, of the grip surface to an overall height, parallel thereto, of the drive housing is between 0.65 and 0.8, preferably between 0.7 and 0.75. The drive device preferably comprises a drive fan, in particular a motor fan, in particular for cooling the electric motor. The drive housing comprises at least one ventilation opening for discharging and/or sucking in air by means of the drive fan. In particular, the drive fan and the ventilation openings are arranged between the electric motor and the grinding device. The grip surface preferably extends in a direction of the axis of rotation from the ventilation openings as far as the machine termination plane. In particular, the grip surface extends in a direction of the axis of rotation over an at least substantially overall length, in particular over more than 50%, preferably over more than 75%, particularly preferably over at least 90% of the overall length, of the electric motor parallel to the axis of rotation. The configuration according to the disclosure makes it possible to provide an advantageously compact hand-held grinding machine. In particular, a separate grip region which is formed in addition to a motor covering can be omitted. In particular, it is possible to provide a hand-held grinding machine which allows an advantageously high degree of user comfort for an advantageously large range of hand sizes and finger lengths.

It is also proposed that the drive housing, in a plane which is perpendicular to the axis of rotation and comprises the longitudinal axis, has a protrusion on either side, wherein a ratio of a maximum transverse extent from protrusion to protrusion of the drive housing relative to a greatest grip-surface transverse extent, in particular that greatest grip-surface transverse extent already mentioned, of the front portion is between 0.75 and 0.9, particularly preferably between 0.8 and 0.85. In an alternative embodiment, it is conceivable that the hand-held grinding machine is formed independently of the dome-shaped grip surface. In the alternative configuration, in particular in the configuration formed independently from the dome-shaped grip surface, the hand-held grinding machine preferably comprises at least the grinding device for receiving or forming the grinding means, the drive device for driving the grinding device, the actuating element for controlling the drive device, and the drive housing, which receives the drive device and comprises the longitudinal-axis portion arranged about the longitudinal axis which is at least substantially perpendicular to the axis of rotation of the drive device, and has the front portion, which surrounds the region of the intersection point of the axis of rotation and the longitudinal axis. In particular, the maximum protrusion transverse extent amounts to between 50 mm and 74 mm, preferably between 55 mm and 70 mm, particularly preferably between 58 mm and 64 mm. The protrusions, in particular the maximum protrusion transverse extent, preferably lie in the same plane as the greatest grip-surface transverse extent, i.e. in the transverse plane. As an alternative, the maximum protrusion transverse extent is arranged in a plane which is at least substantially perpendicular to the axis of rotation and runs in a direction of the axis of rotation in particular spaced apart from the transverse plane. The protrusions are preferably formed and/or arranged mirror-symmetrically in relation to the assembly plane. As an alternative, the protrusions are arranged offset from one another in a direction of the longitudinal axis and/or in a direction of the axis of rotation and/or have different sizes. It is particularly preferable if twice a radius of curvature of the protrusions in a plane which is perpendicular to the axis of rotation and in particular encompasses the maximum protrusion transverse extent corresponds to between 50% and 150%, preferably between 75% and 125%, particularly preferably between 90% and 110%, of the maximum protrusion transverse extent. It is preferable if twice a further radius of curvature of the protrusions in a plane which is perpendicular to the longitudinal axis and in particular encompasses the maximum protrusion transverse extent is smaller than the maximum protrusion transverse extent and is in particular between 0% and 75%, preferably between 5% and 50%, particularly preferably between 10% and 20%, of the maximum protrusion transverse extent. The protrusions are preferably connected to the rest of the drive housing in an edge-free and shoulder-free manner. In particular, a cross section, having the protrusions, of the drive housing perpendicular to the longitudinal axis has an oval-shaped form. In particular, an outer contour of a cross section which is perpendicular to the axis of rotation and has the protrusions has a sinusoidal form. The configuration according to the disclosure advantageously makes it possible to provide a support surface for a finger, in particular for a thumb and/or a little finger, and a risk of a hand slipping in the direction of the longitudinal axis is prevented. In particular, the correct position of the hand on the grip surface can be checked by an operator without having to look at the hand-held grinding machine.

It is furthermore proposed that a grip surface, in particular that grip surface already mentioned, of the drive housing proceeding from the front portion in the direction of the longitudinal axis tapers continuously into a tapering region, delimited by the protrusions, of the longitudinal-axis portion, wherein a ratio of a maximum tapering transverse extent of the tapering region to a greatest grip-surface transverse extent, in particular that greatest grip-surface transverse extent already mentioned, of the front portion is between 0.7 and 0.85, preferably between 0.75 and 0.8. In particular, the tapering transverse extent is between 50 mm and 65 mm, preferably between 55 mm and 60 mm. In particular, the maximum tapering transverse extent runs perpendicularly to the longitudinal axis and perpendicularly to the axis of rotation. The maximum tapering transverse extent preferably lies in the transverse plane which in particular also comprises the maximum grip-surface transverse extent. The control electronics is preferably arranged in the tapering region. The control electronics is preferably arranged in the tapering region on a side of the transverse plane that faces away from the grinding device. A further maximum transverse extent of the tapering region parallel to the axis of rotation preferably amounts to at most 98%, preferably less than 95%, particularly preferably less than 93% of a maximum transverse extent of the longitudinal-axis portion parallel to the axis of rotation. In particular, a concave part of the tapering portion that faces the machine termination plane has a radius of curvature which is larger than, in particular more than twice as large as, the maximum transverse extent of the longitudinal-axis portion parallel to the axis of rotation. A transition between the tapering region and the front portion is preferably formed in a shoulder-free and step-free manner. In particular, the drive housing continuously tapers from the front portion to a minimum, lying in the tapering region, along the longitudinal axis. The configuration according to the disclosure advantageously makes it possible to implement a finger trough on the hand-held grinding appliance, with the result that an advantageously intuitive arrangement of a hand on the grip surface is enabled. In particular, spreading of the hand in order to engage around the grip surface can advantageously be avoided. In particular, it is possible to achieve a large effective contact surface between the grip surface and a hand, in particular with an advantageously small degree of curving of the finger and an advantageously small expenditure of force.

It is furthermore proposed that a grip surface, in particular the grip surface already mentioned, of the drive housing extends from the front portion as far as a plane which is perpendicular to the longitudinal axis and intersects the protrusions. In particular, the grip surface extends as far as a plane which is perpendicular to the longitudinal axis and comprises the maximum protrusion transverse extent. The grip surface optionally extends beyond the protrusions in the direction of an end of the drive housing that faces away from the front angle. In particular, a maximum grip-surface longitudinal extent of the grip surface parallel to the longitudinal axis is greater than the maximum grip-surface height. The grip-surface longitudinal extent on a part of the grip surface that faces the machine termination plane is longer than a part of the grip surface that faces the grinding device. The grip-surface longitudinal extent preferably increases parallel to the axis of rotation, in particular beginning at the ventilation openings in the direction of the machine termination plane. The grip-surface height parallel to the axis of rotation in the front portion is preferably greater than in the tapering region and/or in the plane which intersects the protrusion. The grip-surface height preferably decreases along the longitudinal axis, in particular proceeding from the front portion as far as the protrusions. The protrusions are preferably arranged outside the grip surface. The configuration according to the disclosure makes it possible to provide an advantageously large grip surface.

It is also proposed that a plane which is perpendicular to the longitudinal axis and intersects the protrusions subdivides a maximum longitudinal extent of the drive housing in a ratio of between 0.45 and 0.65. The protrusions are preferably arranged in a plane perpendicular to the longitudinal axis with the electrical power supply interface and/or the control electronics. In particular, a ratio of the maximum grip-surface longitudinal extent to the maximum longitudinal extent of the drive housing without an energy store, which is connected to the electrical power supply interface, amounts to between 0.55 and 0.60. A ratio of the maximum grip-surface longitudinal extent to the maximum longitudinal extent of the drive housing including an energy store, which is arranged on the electrical power supply interface, preferably amounts to between 0.5 and 0.55. The configuration according to the disclosure makes it possible to achieve an advantageously good equilibrium between the drive device and the grinding device. In particular, the grinding device can be displaced over a surface with advantageously little force.

It is also proposed that the hand-held grinding machine comprises a material collection container, which is arranged spaced apart from the drive housing, in particular the grip surface, in a plane perpendicular to the axis of rotation, wherein in at least one configuration a container longitudinal axis of the material collection container runs at least substantially parallel to the longitudinal axis. "Substantially parallel" should be understood here in particular to mean an alignment of a direction relative to a reference direction, in particular in a plane, wherein the direction deviates in particular by less than 8°, advantageously less than 5° and especially advantageously less than 2° from the reference direction. In particular, the material collection container is fastened to the connecting housing unit. In particular, the material collection container is not fastened to the drive housing. In particular, the material collection container is arranged spaced apart from the drive housing. It is preferable for a minimum spacing between the drive housing, in particular from one of the protrusions, and the material collection container to amount to at least 10 mm, preferably more than 15 mm, in particular more than 20 mm. The minimum spacing between the drive housing, in particular one of the protrusions, and the material collection container is preferably smaller than 40 mm, in particular smaller than 30 mm. The configuration according to the disclosure makes it possible to advantageously use the connecting housing unit as a further hand placement surface. In particular, an intermediate space between the drive housing and the grinding device for the placement of a second hand may have an advantageously large configuration, in particular with a constant or even small maximum extent of the hand-held grinding machine parallel to the axis of rotation.

It is also proposed that the hand-held grinding machine comprises an operating element for controlling the grinding device and a material collection container, in particular the material collection container already mentioned, wherein the operating element and the material collection container are arranged on different sides of an assembly plane spanned by the axis of rotation and the longitudinal axis. In particular, the operating element is formed separately from the actuating element. In particular, the operating element is provided for setting an operating parameter of the drive device, for example a rotational speed of the drive shaft. The operating element is preferably arranged in the tapering portion. The operating element is preferably arranged between the transverse plane and the grinding pad. As an alternative, the operating element is arranged in the transverse plane. The operating element is provided in particular for operation with a thumb when index finger and middle finger are arranged in the front portion, in particular on the partial surface area which surrounds the actuating element. The configuration according to the disclosure makes it possible to operate the hand-held grinding machine advantageously easily by a hand. In particular, a movement space for a finger actuating the operating element can be kept advantageously large and in particular is not restricted by the material collection container.

The hand-held grinding machine according to the disclosure is not intended to be limited to the above-described application and embodiment in this respect. In particular, the hand-held grinding machine according to the disclosure may have a number of individual elements, components and units which differs from the number thereof stated herein for the purpose of satisfying a mode of operation described herein. Moreover, for the value ranges specified in this disclosure, values that also lie within the stated limits should also be considered to be disclosed and usable in any desired way.

BRIEF DESCRIPTION OF THE DRAWINGS

Further advantages will become apparent from the following description of the drawing. Four exemplary embodiments of the disclosure are illustrated in the drawings. The drawings, the description and the claims contain numerous features in combination. A person skilled in the art will expediently also consider the features individually and combine them to form useful further combinations.

In the figures.

DETAILED DESCRIPTION

Figure 1:
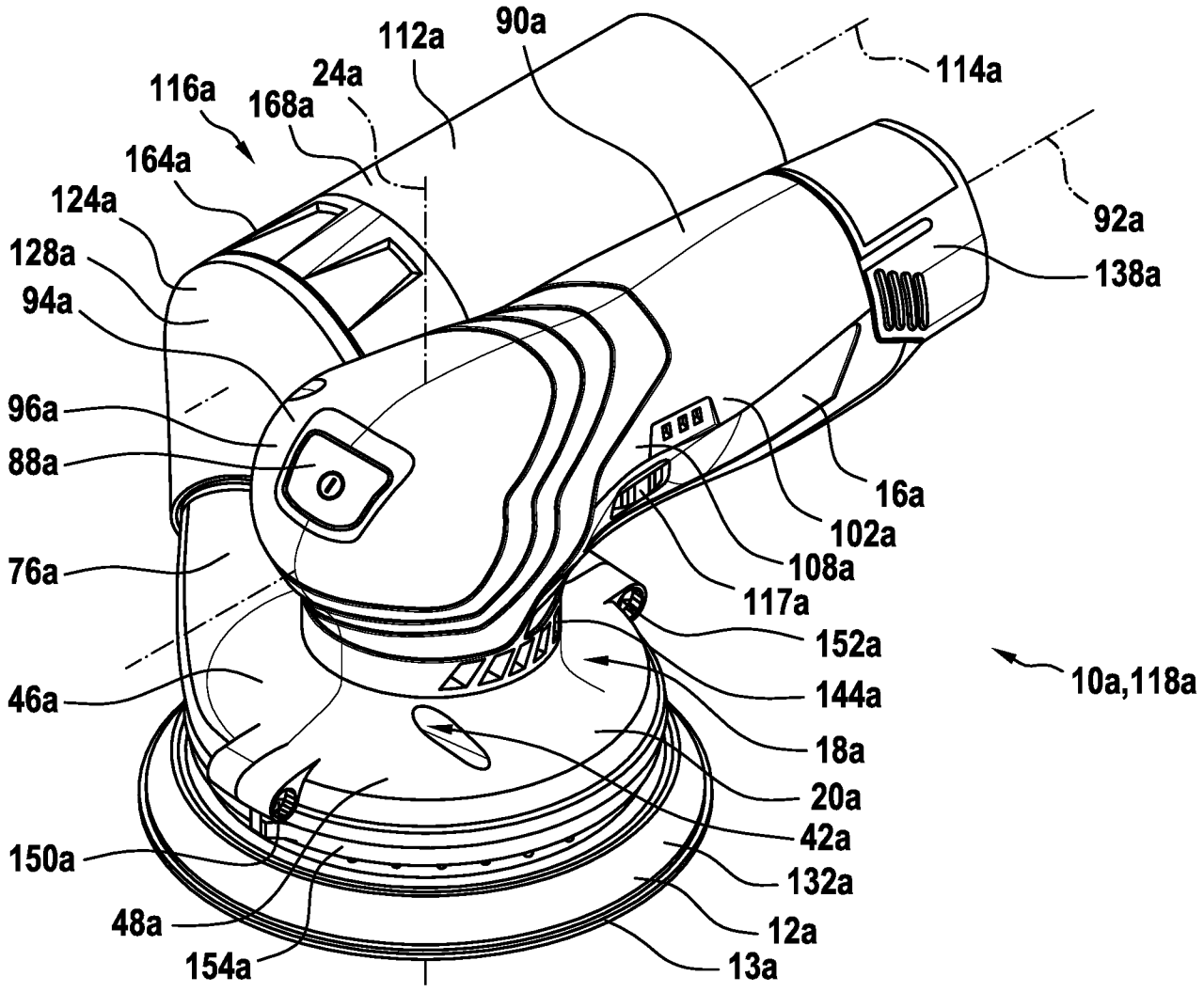
FIG. 1 shows a schematic perspective illustration of a hand-held grinding machine according to the disclosure.

FIG. 1 shows a hand-held power tool 118*a* in the form of a hand-held grinding machine 10*a*. The hand-held grinding machine 10*a* is in the form in particular of an eccentric grinder. The hand-held grinding machine 10*a* comprises a grinding device 12*a* for receiving a grinding means 13*a*. The grinding device 12*a* comprises in particular a grinding pad 132*a*, which is illustrated here by way of example with a diameter of 125 mm. As an alternative, the grinding pad 132*a* has a diameter of 150 mm or another diameter which is adapted to a size of the grinding means 13*a*. The hand-held grinding machine 10*a* comprises a drive device 14*a* for driving the grinding device 12*a* (see FIG. 4), which drive device in particular defines an axis of rotation 24*a* about which the grinding pad 132*a* can be driven, in particular eccentrically. The hand-held grinding machine 10*a* comprises a drive housing 16*a*, which receives the drive device 14*a*.

The drive housing 16*a* has a longitudinal axis 92*a*, which runs at least substantially perpendicular to the axis of rotation 24*a*. The drive housing 16*a* preferably has two drive housing half-shells, which are arranged against one another in an assembly plane 50*a* which is spanned by the longitudinal axis 92*a* and the axis of rotation 24*a* (cf. FIG. 2). The drive housing 16*a* comprises a longitudinal-axis portion 90*a*, which is arranged around the longitudinal axis 92*a*. The longitudinal-axis portion 90*a* is provided in particular for receiving a rechargeable battery pack 138*a*, in particular a 12 volt rechargeable battery pack. The drive housing 16*a* has a front portion 94*a*. The front portion 94*a* surrounds an intersection point region of the axis of rotation 24*a* and the longitudinal axis 92*a*. The front portion 94*a* comprises a dome-shaped grip surface 96*a*. The grip surface 96*a* is optionally in the form of a soft component, which is arranged, in particular recessed, on a housing basic body of the drive housing 16*a*. As an alternative, an outer surface of the housing basic body of the drive housing 16*a* forms the grip surface 96*a*. The hand-held grinding machine 10*a* comprises at least one actuating element 88*a* for controlling the drive device 14*a*, in particular for switching the drive device 14*a* on and off. The actuating element 88*a* is preferably latched in place in an activated state of the drive device 14*a*. The actuating element 88*a* is arranged in the grip surface 96*a*. The actuating element 88*a* is arranged on a side, facing away from the longitudinal-axis portion 90*a*, of a plane which is perpendicular to the longitudinal axis 92*a* and encompasses the axis of rotation 24*a*.

The hand-held grinding machine 10*a* comprises an interface device 18*a* for operatively connecting, in particular for coupling, the grinding device 12*a* to the drive device 14*a*. The interface device 18*a* is arranged in particular along the axis of rotation 24*a* on the front portion 94*a*. The interface device 18*a* comprises at least one connecting housing unit 20*a* for at least partially receiving the grinding device 12*a*. The connecting housing unit 20*a* is formed separately from the drive housing 16*a* and the grinding device 12*a*. The connecting housing unit 20*a* has at least two main shells 46*a*, 48*a*. The main shells 46*a*, 48*a* are arranged in particular against one another in the assembly plane 50*a*. The main shells 46*a*, 48*a* are preferably manufactured from plastic. The main shells 46*a*, 48*a* preferably have a wall thickness of between 1 mm and 3.5 mm, preferably between 1.5 mm and 2.5 mm, particularly preferably between 1.9 mm and 2.3 mm. The connecting housing unit 20*a* comprises an ejection port 76*a*. The ejection port 76*a* is provided in particular for ejecting material that has been worn off during a grinding process from the connecting housing unit 20*a*. The ejection port 76*a* is preferably arranged on one of the main shells 46*a*. The hand-held grinding machine 10*a* comprises a material collection device 116*a*. The material collection device 116*a* comprises a material collection container 112*a*, which is preferably air-permeable, for collecting material, such as in particular dust, chips and/or grit, which has been removed by the hand-held grinding machine 10*a*, and in particular ejected via the ejection port 76*a*. In at least one configuration of the material collection container 112*a*, a container longitudinal axis 114*a* of the material collection container 112*a* runs at least substantially parallel to the longitudinal axis 92*a* of the drive housing 16*a*.

Figure 2:
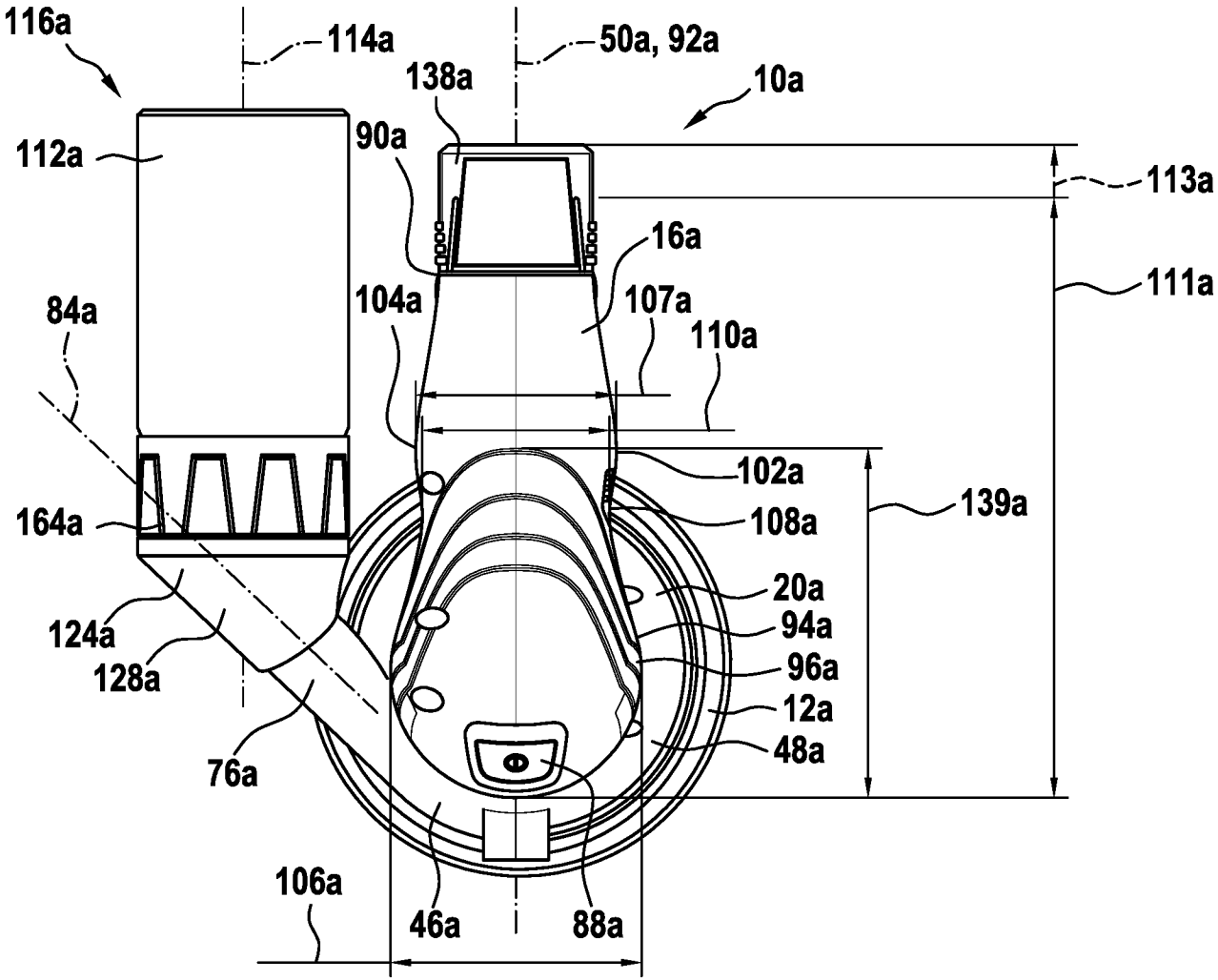
FIG. 2 shows a schematic plan view of the hand-held grinding machine according to the disclosure.

FIG. 2 shows a view of the hand-held grinding machine 10*a* along the axis of rotation 24*a*. The drive housing 16*a* has a protrusion 102*a*, 104*a* to either side of a plane which is perpendicular to the axis of rotation 24*a* and encompasses the longitudinal axis 92*a*. A ratio of a maximum protrusion transverse extent 107*a* of the protrusion 102*a* to that of the protrusion 104*a* of the drive housing 16*a* relative to a largest grip-surface transverse extent 106*a* of the front portion 94*a* is between 0.75 and 0.9, in particular between 0.80 and 0.85. The largest grip-surface transverse extent 106*a* is preferably at the same time the largest transverse extent of the drive housing 16 perpendicular to the axis of rotation 24*a* and perpendicular to the longitudinal axis 92*a*. The largest grip-surface transverse extent 106*a* amounts, in relation to an overall height 54*a* (cf. FIGS. 3 and 4) of the drive housing 16*a*, to preferably between 0.8 and 0.95, in particular between 0.85 and 0.9. The largest grip-surface transverse extent 106*a* preferably amounts to between 65 mm and 85 mm, in particular between 70 mm and 80 mm. In particular, the overall height 54*a* of the drive housing 16*a* parallel to the axis of rotation 24*a* is smaller than 95 mm, preferably smaller than 90 mm, in particular smaller than 85 mm. A maximum machine height parallel to the axis of rotation 24*a* of the hand-held grinding machine 10*a* is particularly preferably smaller than 115 mm, in particular smaller than 110 mm.

The grip surface 96*a* of the drive housing 16*a* transitions, proceeding from the front portion 94*a*, continuously in the direction of the longitudinal axis 92*a* into a tapering region 108*a*, delimited by the protrusions 102*a*, 104*a*, of the longitudinal-axis portion 90*a*. A ratio of a maximum tapering transverse extent 110*a* of the tapering region 108*a* to the largest grip-surface transverse extent 106*a* of the front portion 94*a* is between 0.7 and 0.85, in particular between 0.75 and 0.8. The grip surface 96*a* of the drive housing 16*a* extends from the front portion 94*a* to a plane which is perpendicular to the longitudinal axis 92*a* and intersects the protrusions 102*a*, 104*a*. The grip surface 96*a* optionally extends along the longitudinal axis 92*a* over the protrusions 102*a*, 104*a*. A plane which is perpendicular to the longitudinal axis 92*a* and intersects the protrusions 102*a*, 104*a*, subdivides a maximum longitudinal extent 111*a*, 113*a* of the drive housing 16*a* in a ratio of between 0.45 and 0.65. In particular, a ratio of a protrusion position 139*a* of the plane, intersecting the protrusions 102*a*, 104*a*, along the longitudinal axis 92*a* proceeding from a point of the front portion 94*a* that is furthest away from the maximum longitudinal extent 111*a* without a rechargeable battery pack 138*a* amounts to between 0.55 and 0.60. In particular, a ratio of a protrusion position 139*a* of the plane, intersecting the protrusions 102*a*, 104*a*, along the longitudinal axis 92*a* proceeding from a point of the front portion 94*a* that is furthest away from the maximum longitudinal extent 113*a* including a rechargeable battery pack 138*a* amounts to between 0.5 and 0.55. In particular, the maximum longitudinal extent 111*a*, 113*a* parallel to, in particular along, the longitudinal axis 92*a* is greater than the overall height 54*a* of the drive housing 16*a*.

The material collection container 112*a* is arranged spaced apart from the grip surface 96*a* of the drive housing 16*a* in a plane which is perpendicular to the axis of rotation 24*a*. In particular, the material collection container 112*a* is arranged only on the ejector port 76*a* by means of an assembly unit 124*a* of the material collection device 116*a*, in particular in a suspended manner and in particular without further support elements. A transition between the assembly unit 124*a* and the material collection container 112*a* is arranged in a plane which is perpendicular to the longitudinal axis 92*a* with the tapering region 108*a*. A channel longitudinal axis 84*a* of the ejector port 76*a* of the connecting housing unit 20*a* is aligned at an acute angle, in particular between 40° and 50°, preferably between 44° and 46°, to the longitudinal axis 92*a* in a plane which is perpendicular to the axis of rotation 24*a*. The channel longitudinal axis 84*a* is preferably in the form of a channel center axis, which runs in particular through a geometric center of gravity of the ejector port 76*a*. The hand-held grinding machine 10*a* has an operating element 117*a*, in particular one which is different from the actuating element 88*a*, for controlling the grinding device 12*a* (cf. FIG. 1), for example for matching a rotational speed of the grinding pad 132*a*. For example, the operating element 117*a* is in the form of a rotary controller. The operating element 117*a* and the material collection container 112*a* are arranged on different sides of the assembly plane 50*a* spanned by the axis of rotation 24*a* and the longitudinal axis 92*a*. The drive housing 16*a* has a spacing from the material collection container 112*a* which is between 10 mm and 40 mm, preferably between 15 mm and 35 mm, particularly preferably between 20 mm and 30 mm. The operating element 117*a* is preferably arranged in the tapering region 108*a*. The operating element 117*a* and the actuating element 88*a* are preferably arranged on different sides of a transverse plane 98*a* which is perpendicular to the axis of rotation 24*a* and in which the front portion 94*a* has the largest grip-surface transverse extent 106*a*.

Figure 3:
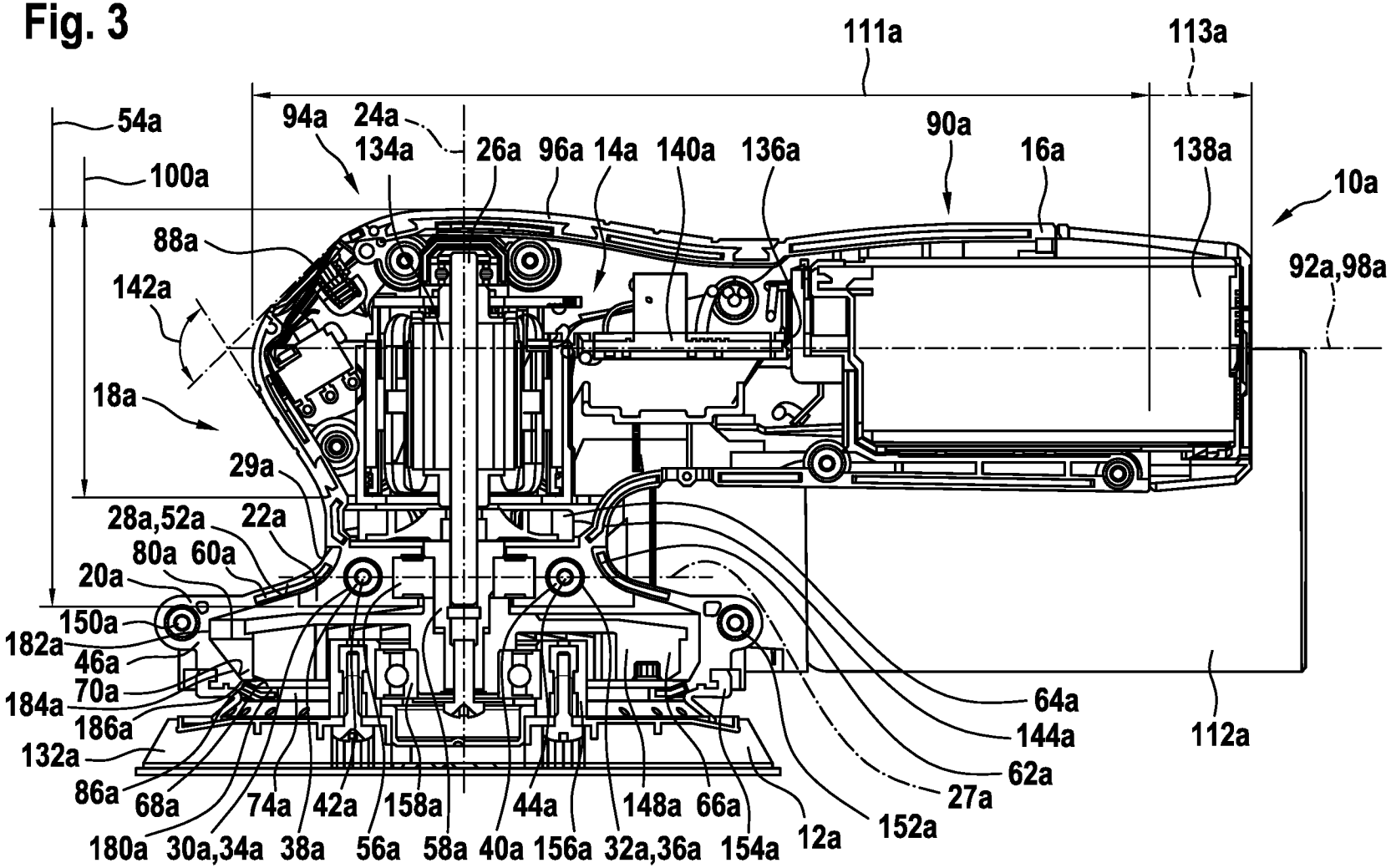
FIG. 3 shows a schematic longitudinal section of the hand-held grinding machine according to the disclosure.
Figure 4:
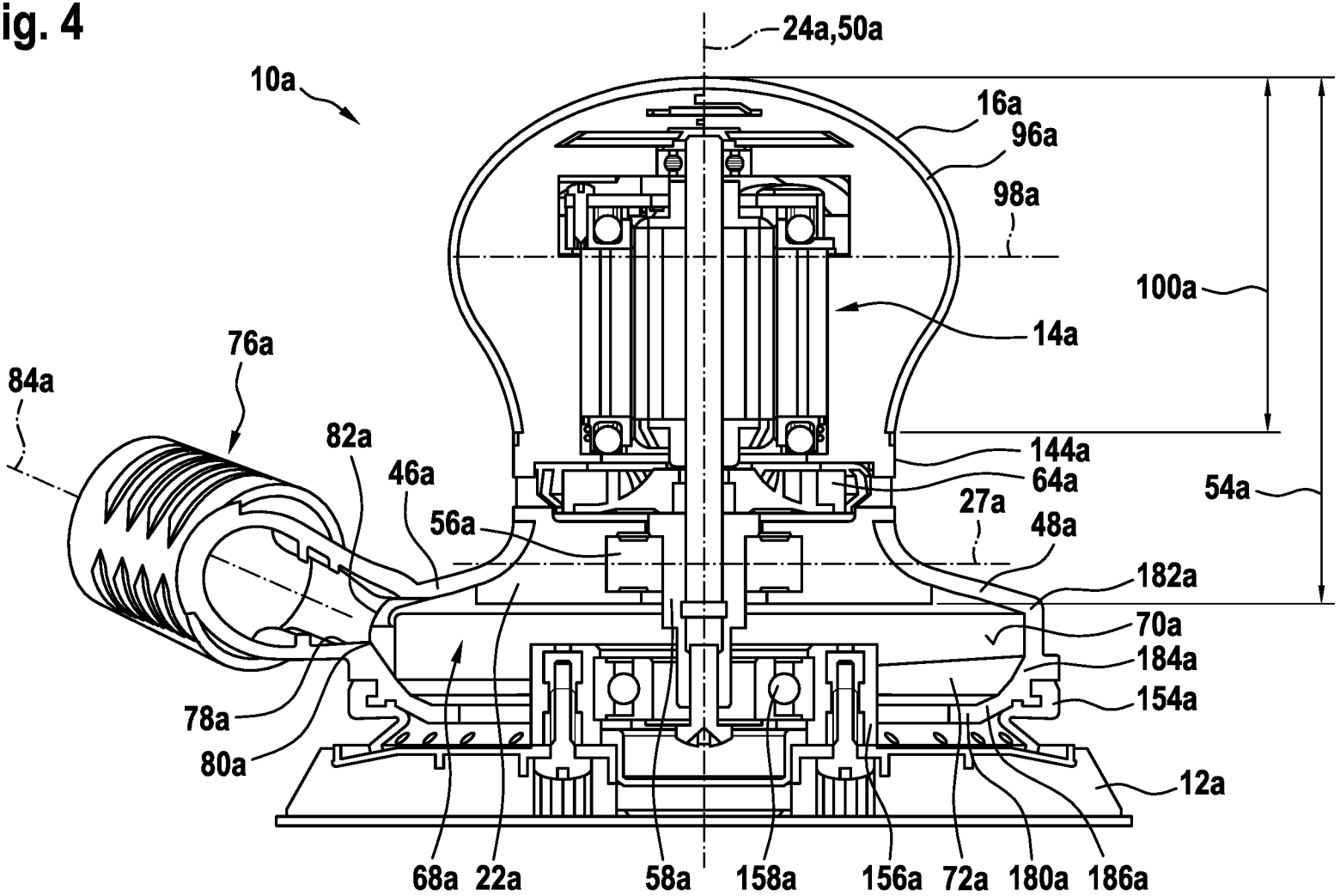
FIG. 4 shows a schematic cross section of the hand-held grinding machine according to the disclosure.

FIG. 3 shows a longitudinal section of the hand-held grinding machine 10*a* in the assembly plane 50*a* and FIG. 4 shows a cross section of the hand-held grinding machine 10*a*. The grinding device 12*a* preferably comprises an eccentric, which is driven by a drive shaft 26*a*. The grinding device 12*a* preferably comprises an eccentric bearing 158*a*, which is in particular in the form of a ball bearing. The eccentric bearing 158*a* optionally comprises a plurality of ball bearings, which are in particular stacked one on top of another along the axis of rotation 24*a*, or a multi-row, in particular two-row, ball bearing. The eccentric bearing 158*a* is arranged in particular on the eccentric and engages around the eccentric preferably in a plane which is perpendicular to the axis of rotation 24*a*. The eccentric bearing 158*a* is clamped on an offset of the eccentric, in particular by means of an assembly plate and a screw. In particular, a geometric center point of the eccentric bearing 158*a* is arranged spaced apart from the axis of rotation 24*a*. In particular, the grinding device 12*a* comprises an annular grinding-pad holder 156*a*. The grinding-pad holder 156*a* is arranged on the eccentric bearing 158*a* and engages around it preferably in a plane which is perpendicular to the axis of rotation 24*a*. The grinding-pad holder 156*a* preferably has a groove, in which the eccentric bearing 158*a* is arranged. The eccentric bearing is particularly preferably formed such that it is injection molded around the grinding-pad holder 156*a*. In particular, the grinding-pad holder 156*a* can be rotated relative to the eccentric. The grinding pad 132*a* is preferably fastened to the grinding-pad holder 156*a*, in particular screw-connected in a direction parallel to the axis of rotation 24*a*. In particular, the grinding device 12*a* optionally comprises a fan 66*a*. In particular, the fan 66*a* is operated by the drive shaft 26*a*. A blading of the fan 66*a* preferably surrounds the grinding-pad holder 156*a* in a plane which is perpendicular to the axis of rotation 24*a*, wherein the grinding-pad holder 156*a* projects beyond the fan 66*a* in a direction of the axis of rotation 24*a*. The grinding device 12*a* preferably comprises a slip ring 154*a* of an elastic material, which slip ring is fastened in a rotationally fixed manner to the connecting housing unit 20*a* on the connecting housing unit 20*a* in a groove, and in particular rests on the grinding pad 132*a*, in particular in order to stabilize a rotational movement of the grinding pad 132*a*.

The drive device 14*a* preferably comprises an electric motor 134*a*. In particular, the electric motor 134*a* incorporates a rated voltage of 12 volts. The drive device 14*a* comprises the drive shaft 26*a*, which is driven in particular by the electric motor 134*a* about the axis of rotation 24*a*. In particular, the drive device 14*a* comprises an electrical power supply interface 136*a*, in particular for connecting the rechargeable battery pack 138*a*. The drive device 14*a* preferably comprises at least one control electronics 140*a*, in particular for controlling the electric motor 134*a*. The electric motor 134*a*, the control electronics 140*a* and the electrical power supply interface 136*a* are preferably arranged along the longitudinal axis 92*a*, in particular in this order. In particular, the electric motor 134*a* is arranged in the front portion 94*a*. In particular, the control electronics 140*a* is arranged in the tapering region 108*a*. In particular, the electrical power supply interface 136*a* is arranged in the longitudinal-axis portion 90*a*. The drive shaft 26*a* preferably protrudes proceeding from the front portion 94*a* into the interface device 18*a*.

The actuating element 88*a* is arranged, in particular recessed, in a partial surface area, arranged obliquely to the longitudinal axis 92*a* and to the axis of rotation 24*a*, of the grip surface 96*a*. The partial surface area which receives the actuating element 88*a* preferably has an angle of between 40° and 50° to the longitudinal axis 92*a*. A projection of the actuating element 88*a* along the axis of rotation 24*a* in particular does not overlap the electric motor 134*a*. The actuating element 88*a* and the grinding device 12*a* are arranged on different sides of the transverse plane 98*a* which is at least substantially perpendicular to the axis of rotation 24*a* and in which the front portion 94*a* has the largest grip-surface transverse extent 106*a*. In particular, more than half, preferably more than 66%, particularly preferably more than 75%, of a volume of the electric motor 134*a* is arranged on that side of the transverse plane 98*a* which is opposite the actuating element 88*a*. Between 40% and 60% of a volume of a receiving region of the electrical power supply interface 136*a* for receiving the rechargeable battery pack 138*a* is preferably arranged on that side of the transverse plane 98*a* which is opposite the actuating element 88*a*. In particular, the partial surface area, surrounding the actuating element 88*a*, of the grip surface 96*a* is flattened, in particular has a planar form in sections, in the assembly plane 50*a*. The front portion 94*a* of the transverse plane 98*a* preferably has a continuously curved profile. Partial surface areas of the grip surface 96*a*, one of which surrounds the actuating element 88*a* and which terminate the front portion 94*a* along the longitudinal axis 92*a*, are arranged at a front angle 142*a* of between 95° and 110° to one another. The front angle 142*a* is in particular in the assembly plane 50*a*. In particular, the partial surface areas terminating the front portion 94*a* are arranged on different sides of the transverse plane 98*a* which faces the largest grip-surface transverse extent 106*a* and runs perpendicular to the axis of rotation 24*a*.

A ratio of a maximum grip-surface height 100*a*, parallel to the axis of rotation 24*a*, of the grip surface 96*a* to the overall height 54*a*, parallel to said maximum grip-surface height, of the drive housing 16*a*, is between 0.65 and 0.8 and preferably between 0.7 and 0.75. In particular, the grip surface 96*a* extends in a direction of the axis of rotation 24*a* as far as an end of the electric motor 134*a* that faces the grinding device 12*a*. The drive device 14*a* preferably comprises a drive fan 64*a*, in particular for cooling the electric motor 134*a*. The drive fan 64*a* is arranged on the axis of rotation 24*a* between the electric motor 134*a* and the interface device 18*a*. The grip surface 96*a* preferably extends in a direction of the axis of rotation 24*a* as far as a fan portion 144*a* of the drive housing 16*a*, in which ventilation openings for sucking in and/or blowing out air through the drive fan 64*a* are arranged. The grip-surface height 100*a* preferably decreases, in particular continuously, in a direction of the longitudinal axis 92*a* (cf. also FIG. 5). The drive fan 64*a* and the longitudinal-axis portion 90*a* are preferably arranged, in particular completely, on different sides of a plane which is perpendicular to the axis of rotation 24*a*. The front portion 94*a* preferably tapers in a direction of the axis of rotation 24*a* to the fan portion 144*a*. In particular, the actuating element 88*a* projects along the longitudinal axis 92*a* at least partially beyond the fan portion 144*a*. A unit composed of the drive housing 16*a* and the connecting housing unit 20*a* preferably has, on the fan portion 144*a*, a cross section, perpendicular to the axis of rotation 24*a*, between the actuating element 88*a* and the grinding device 12*a* that has the smallest surface area. In particular, the fan portion 144*a* has a maximum transverse extent perpendicular to the axis of rotation 24*a* of less than 65 mm, preferably less than 60 mm, particularly preferably less than 55 mm.

The interface device 18*a* comprises a docking interface 22*a*, which is arranged on the drive housing 16*a*. The connecting housing unit 20*a* engages around the docking interface 22*a* in a fixing plane 27*a* perpendicular to the axis of rotation 24*a* of the drive shaft 26*a* of the drive device 14*a*. The docking interface 22*a* has, in the fixing plane 27*a*, at least one axial form-fitting element 28*a*, 29*a*, 30*a*, 32*a* for forming a form fit, parallel to the axis of rotation 24*a*, with the connecting housing unit 20*a*. A projection of the axial form-fitting element 28*a*, 29*a*, 30*a*, 32*a* along the axis of rotation 24*a* is at least substantially completely inside the drive housing 16*a*. In particular, the docking interface 22*a* comprises a plurality of axial form-fitting elements 28*a*, 29*a*, 30*a*, 32*a*, the projections of which along the axis of rotation 24*a* are at least substantially completely inside the drive housing 16*a*. In particular, a projection of the entire docking interface 22*a* is at least substantially completely inside the drive housing 16*a*. The docking interface 22*a* is preferably arranged along the axis of rotation 24*a* on the front portion 94*a*. In particular, the fan portion 144*a* is arranged between the front portion 94*a* and the docking portion 22*a*. The docking interface 22*a* is preferably materially bonded to the drive housing 16*a*. In particular, the overall height 54*a* of the drive housing 16*a* refers to an extent which is parallel to the axis of rotation 24*a* and also includes the docking interface 22*a*.

The docking interface 22*a*, as axial form-fitting element 30*a*, 32*a*, comprises a fixing recess 34*a*, 36*a*. The fixing recess 34*a*, 36*a* preferably extends at least substantially parallel to the fixing plane 27*a*. In particular, the fixing recess 34*a*, 36*a* is provided to receive a fixing element 38*a*, 40*a* of the connecting housing unit 20*a* and a separately formed fixing element 42*a*, 44*a*. The fixing element 38*a*, 40*a* of the connecting housing unit 20*a* is in the form of a sleeve, particularly preferably a screw boss. The sleeve is designed to receive the separately formed fixing element 42*a*, 44*a*. The separately formed fixing element 42*a*, 44*a* is preferably in the form of a screw. An overall receiving length of the sleeve corresponds in particular substantially, but in particular not completely, to a length of the separately formed fixing element 42*a*, 44*a*. In particular, the sleeve comprises two sleeve portions, one of which is arranged on each of the two main shells 46*a*, 48*a*, with the result that there is an air gap between the two sleeve portions. In particular, the main shells 46*a*, 48*a* are fastened to the docking interface 22*a* under tension by tightening the separately formed fixing element 42*a*, 44*a* in the sleeve. In particular, the separately formed fixing element 42*a*, 44*a* engages in, and in particular through, the docking interface 22*a*. In the fixing plane 27*a*, the docking interface 22*a* preferably comprises at least two, in particular exactly two, copies of the fixing element 38*a*, 40*a* per main shell 46*a*, 48*a* and in particular at least two, in particular exactly two, copies of the separately formed fixing element 42*a*, 44*a*, which are arranged in particular on different sides of a plane which is perpendicular to the longitudinal axis 92*a* and encompasses the axis of rotation 24*a*. The connecting housing unit 20*a* optionally comprises at least one additional fixing element 150*a*, 152*a*, which is provided to fasten the main shells 46*a*, 48*a* to one another at a position spaced apart from the fixing plane 27*a*. The connecting housing unit 20*a* preferably comprises at least two additional fixing elements 150*a*, 152*a*, which are arranged in particular between the fixing plane 27*a*, in particular between that end of the docking interface 22*a* which faces the grinding pad 132*a*, and the grinding pad 132*a*. In particular, the additional fixing elements 150*a*, 152*a* are in the form of screws. Additional fixing recesses for the main shells 46*a*, 48*a* for receiving the additional fixing elements 150*a*, 152*a* are preferably arranged in a plane which is parallel to the fixing plane 27*a* and comprises the greatest transverse extent of the connecting housing unit 20*a* in the assembly plane 50*a*.

Perpendicular to the axis of rotation 24*a*, the docking interface 22*a*, as axial form-fitting element 28*a*, encompasses a docking cross section which tapers along the axis of rotation 24*a* in a direction away from the grinding device 12*a* and in particular leading toward the fan portion 144*a*. In particular, the fixing recess 34*a*, 36*a* is arranged between a maximum cross section of the docking interface 22*a* perpendicular to the axis of rotation 24*a* and a minimum cross section of the docking interface 22*a* perpendicular to the axis of rotation 24*a*. The docking interface 22*a* preferably comprises a contact surface 52*a*, which is formed on a surface of the docking interface 22*a* that forms the taper. The contact surface 52*a* faces away in particular from the grinding device 12*a* and faces in particular the drive device 14*a*. The main shells 46*a*, 48*a* have in particular a mating surface, complementary to the contact surface 52*a*, on one of their respective inner walls. The mating surfaces of the main shells 46*a*, 48*a* are arranged in particular on the contact surface 52*a* and particularly preferably pressed against the contact surface 52*a* over their surface area by means of the fixing elements 42*a*. At a boundary, which is at least substantially perpendicular to the axis of rotation 24*a*, to the drive housing 16*a*, in particular to the fan portion 144*a*, the docking interface 22*a*, as axial form-fitting element 29*a*, has a smaller cross section than the drive housing 16*a*. In particular, a difference in the cross sections of the docking interface 22*a* and of the drive housing 16*a* at the boundary corresponds to a wall thickness, in particular twice the wall thickness, of the connecting housing unit 20*a*. A portion of the main shells 46*a*, 48*a* which forms the mating surfaces extends preferably along the contact surface to the boundary. The connecting housing unit 20*a* is arranged at least substantially flush with the drive housing 16*a* on the docking interface 22*a*. The docking interface 22*a*, in particular the contact surface 52*a*, encompasses at least 10% to 20% of the overall height 54*a* of the drive housing 16*a* including the docking interface 22*a* parallel to the axis of rotation 24*a*. It is preferably the case that a ratio of a docking height of the docking interface 22*a* parallel to the axis of rotation 24*a* to a maximum transverse extent, in particular a maximum diameter, of the docking interface 22*a* perpendicular to the axis of rotation is between 0.1 and 0.3, preferably between 0.15 and 0.2. It is preferably the case that a ratio of the docking height of the docking interface 22*a* parallel to the axis of rotation to a minimum transverse extent, in particular a minimum diameter, of the docking interface 22*a* perpendicular to the axis of rotation 24*a* is between 0.15 and 0.35, preferably between 0.2 and 0.25. It is preferably the case that a spacing parallel to the axis of rotation 24*a* between the maximum transverse extent and the minimum transverse extent of the docking interface 22*a* perpendicular to the axis of rotation 24*a* corresponds to at least 60%, preferably more than 75%, of the docking height.

The contact surface 52*a* runs transversely to the fixing plane 27*a* and has a curved form. The mating surface has a curvature which complements the contact surface 52*a*. The curvature of the contact surface 52*a* and in particular of the mating surface preferably have a concave form with respect to the axis of rotation 24*a*. A radius of curvature which describes the contact surface 52*a* and in particular the mating surface runs outside the docking interface 22*a* and in particular through the connecting housing unit 20*a*. The radius of curvature amounts to between 5 mm and 15 mm, preferably between 9 mm and 10 mm. A curvature center point which is part of the radius of curvature preferably lies outside the connecting housing unit 20*a*. The wall thickness of the connecting housing unit 20*a* optionally decreases along the curvature in the direction of the drive housing 16*a*. As an alternative, the wall thickness of the connecting housing unit 20*a* is constant along the curvature. The contact surface 52*a* preferably encompasses a planar contact portion, which continues the curvature of the docking interface 22*a* tangentially in the direction of the grinding pad 132*a*. In particular, the planar contact portion of the contact surface 52*a* is inclined with respect to the fixing plane 27*a* at an angle of between 10° and 20° in the direction of the grinding pad 132*a*. A portion of the main shells 46*a*, 48*a* that forms the mating surfaces preferably extends over the planar contact portion, in particular at the same angle to the fixing plane 27*a* as the planar contact portion of the contact surface 52*a*. This extent of the main shells 46*a*, 48*a* continues in particular as far as one end of the connecting housing unit 20*a* in this direction or as far as the additional fixing recesses or as far as the ejector port 76*a*. In particular, a top side, facing the drive device 14*a*, of the main shells 46*a*, 48*a* forms a hand placement surface, which is inclined in particular relative to the grinding pad 132*a* and falls away in particular outward from the axis of rotation 24*a*, in particular for supporting natural holding in the hand when thumb and index finger are arranged on different sides of the axis of rotation 24*a*. The main shells 46*a*, 48*a* are aligned against one another by means of at least one tongue and groove connection 60*a*, 62*a*, which is in particular curved and preferably is convexly formed with respect to the axis of rotation 24*a*, of the connecting housing unit 20*a* in the fixing plane 27*a*.

Figure 5:
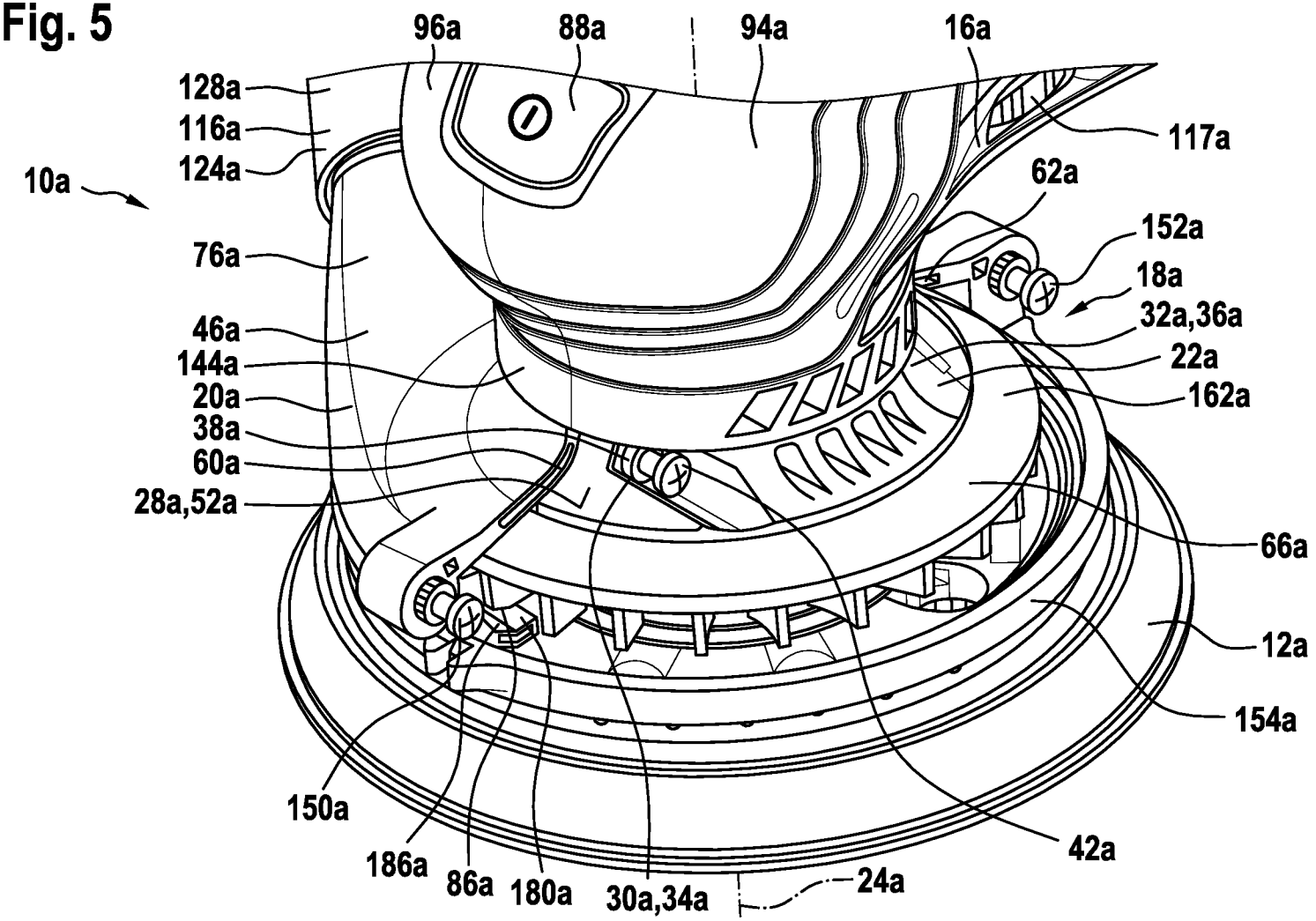
FIG. 5 shows a schematic illustration of a fastening of a connecting housing unit of the hand-held grinding machine according to the disclosure.

FIG. 5 illustrates the interface device 18*a* without one of the main shells 48*a*. The docking interface 22*a* has, as basic body, in particular a rotary body with respect to the axis of rotation 24*a*. As an alternative, the basic body of the docking interface 22*a* extends parallel to the longitudinal axis 92*a* and has in particular an elliptical or tapering cross section perpendicular to the axis of rotation 24*a*. The docking interface 22*a* has, recessed in the basic body, depressions, access shafts, in particular for the sleeve of the main shells 46*a*, 48*a* and the separately formed fixing element 42*a*, 44*a*, and/or ventilation openings.

It is also clear from FIGS. 3 and 4 that the interface device 18*a* comprises a gear mechanism element 58*a*. The gear mechanism element 58*a* of the interface device 18*a* is in the form in particular of an eccentric shank. The gear mechanism element 58*a* of the interface device 18*a* is preferably formed separately from the drive device 14*a* and the grinding device 12*a*. The gear mechanism element 58*a* of the interface device 18*a* is preferably pressed on the drive shaft 26*a* along the axis of rotation 24*a* and in particular connected to the drive shaft 26*a* for rotation therewith. The eccentric, in particular together with the already mentioned assembly plate, is preferably screwed on the gear mechanism element 58*a* of the interface device 18*a* and in particular connected to the gear mechanism element 58*a* of the interface device 18*a* for rotation therewith. As an alternative, the gear mechanism element 58*a* is formed integrally with the drive shaft 26*a* or with the eccentric of the grinding device 12*a*. The docking interface 22*a* engages around a bearing element 56*a* of the drive device 14*a* in the fixing plane 27*a*, which bearing element is configured for rotatably mounting the gear mechanism element 58*a* of the interface device 18*a*. The drive shaft 26*a* preferably extends along the axis of rotation 24*a* into the bearing element 56*a*, in particular through the bearing element 56*a*. The gear mechanism element 58*a* preferably surrounds the drive shaft 26*a* in the fixing plane 27*a*, such that the drive shaft 26*a* in particular is not in direct contact with the bearing element 56*a*. In particular, the bearing element 56*a* is in the form of a ball bearing. The gear mechanism element 58*a* of the interface device 18*a* preferably extends along the axis of rotation 24*a* through the bearing element 56*a*. In particular, the gear mechanism element 58*a* of the interface device 18*a* has a greater maximum transverse extent perpendicular to the axis of rotation 24*a* on a side of the fixing plane 27*a* which faces the drive device 14*a* than on a side of the fixing plane 27*a* which faces the grinding device 12*a*, for the purpose of an axial form fit along the axis of rotation 24*a* with the bearing element 56*a*. The fan 66*a* of the grinding device 12*a* is preferably arranged on the gear mechanism element 58*a* of the interface device 18*a*, in particular for centric rotation about the axis of rotation 24*a*. The fan 66*a* is not illustrated in FIG. 4 in order to ensure that an inner wall 70*a* of the main shells 46*a*, 48*a* can be seen.

The fan 66*a* has an asymmetrical form for the purpose of forming a gear mechanism element of the grinding device 12*a*. In particular, the fan 66*a* forms the eccentric. In particular, the fan 66*a* has a disk-shaped base plate, which is in particular solid, and to which the blading of the fan 66*a* is fastened. The base plate preferably faces the docking interface 22*a* and is arranged in particular in the same plane perpendicular to the axis of rotation 24*a* as the additional fixing elements 150*a*, 152*a*. The blading of the fan 66*a* preferably faces the grinding pad 132*a*. In particular, as eccentric the fan 66*a* has a central shank, which is surrounded by the blading in a plane which is perpendicular to the axis of rotation 24*a*. In particular, the central shank is arranged on the base plate eccentrically in relation to the base plate. The gear mechanism element 58*a* of the interface device 18*a* preferably engages in the central shank, forming the eccentric, of the fan 66*a* and is connected to it in particular for rotation therewith (cf. FIG. 6). The fan 66*a* preferably has at least one fan counterbalance 148*a*, which is arranged inside the blading. In particular, a shape of the fan counterbalance 148*a* is matched to a shape of the blading. The base plate of the fan 66 preferably has a recess 162*a*, which is arranged offset with respect to the rest of the base plate at least substantially parallel to the axis of rotation 24*a*. The recess 162*a* is in the form in particular of a half-ring. The recess 162*a* and the fan counterbalance 148*a*, in particular together with part of the blading, is preferably arranged on the recess 162*a*. In a section of the fan 66*a* along a plane encompassing the axis of rotation 24*a*, the recess 162*a* and the fan counterbalance 148*a* are arranged in particular in a half of the fan 66*a* which comprises a smaller volume fraction of the central shank which is in the form of an eccentric. A height of the blading on the recess 162*a* parallel to the axis of rotation 24*a* is preferably smaller than a height of the rest of the part of the blading, in particular with the result that the entire blading of the fan 66*a* has a common termination plane which is perpendicular to the axis of rotation 24*a*. The drive fan 64*a* of the drive device 14*a* and the fan 66*a* of the grinding device 12*a* are arranged on different sides of the axial form-fitting element 28*a*, 29*a*, 30*a*, 32*a* in the direction of the axis of rotation 24*a*. In particular, at the boundary the docking interface 22*a* terminates a receiving space of the drive housing 16*a* in which the drive fan 64*a* is arranged. In particular, an end of the docking interface 22*a* along the axis of rotation 24*a* delimits a fan receiving region 68*a*, in which the fan 66*a* is arranged.

The grinding device 12*a* comprises the fan 66*a* for the purpose of transporting away material removed during a grinding operation. The inner wall 70*a*, which delimits the fan receiving region 68*a*, of the connecting housing unit 20*a* is in the form of a funnel about the axis of rotation 24*a* of the drive shaft 26*a* of the drive device 14*a* in order to guide an air stream created by the fan 66*a*. In particular, the fan receiving region 68*a* narrows along the axis of rotation 24*a* in the direction of the grinding pad 132*a* proceeding from the plane which is perpendicular to the axis of rotation 24*a* and in which the additional fixing elements 150*a*, 152*a* are arranged. The main shells 46*a*, 48*a* of the connecting housing unit 20*a* at least partially surround the fan 66*a* in the assembly plane 50*a*, which is parallel to the axis of rotation 24*a*. In particular, the main shells 46*a*, 48*a* surround the fan 66*a*, in particular the blading thereof, in a direction parallel to the axis of rotation 24*a*. In particular, the main shells 46*a*, 48*a* comprise at least one base portion 180*a*, which is arranged between the fan 66*a* and the grinding pad 132*a*. The connecting housing unit 20*a* has an air inlet 74*a*. The air inlet 74*a* is preferably arranged in the base portion 180*a* of the main shells 46*a*, 48*a*. In particular, the base portion 180*a* has a base surface which faces the fan 66*a* and runs at least substantially perpendicularly to the axis of rotation 24*a*. A maximum transverse extent of the base surface perpendicular to the axis of rotation 24*a* is in particular smaller than a maximum transverse extent of the fan 66*a* perpendicular to the axis of rotation 24*a*. The grinding-pad holder 156*a* projects in particular through the air inlet 74*a*, in particular without making contact with the main shells 46*a*, 48*a*. The eccentric bearing 158*a*, the gear mechanism element 58*a* and/or the eccentric are arranged at least substantially flush with the base portion 180*a* of the main shells 46*a*, 48*a* or are arranged set back in the direction of the drive device 14*a* relative to the base portion 180*a*.

The inner wall 70*a* is segmented in a direction of the axis of rotation 24*a*. A mouth opening 78*a* in the ejector port 76*a* of the connecting housing unit 20*a* and the air inlet 74*a* of the connecting housing unit 20*a* are arranged in different segments of the inner wall 70*a*. In particular, the mouth opening 78*a* is arranged in an ejector segment 182*a* of the connecting housing unit 20*a*. The inner wall 70*a* runs in the ejector segment 182*a* preferably at least substantially perpendicular to the axis of rotation 24*a*. In particular, the ejector segment 182*a* is arranged in the plane with the additional fixing elements 150*a*, 152*a*. The connecting housing unit 20*a* preferably comprises at least one guide segment 184*a*, which is arranged in a direction of the axis of rotation 24*a* between the ejector segment 182*a* and the base portion 180*a*. The inner wall 70*a* runs in the guide segment 184*a* in particular at an acute angle to the axis of rotation 24*a*. The connecting housing unit 20*a* preferably comprises at least one further guide segment 186*a*, which is arranged between the guide segment 184*a* and the base portion 180*a*. In particular, the inner wall 70*a* in a further guide segment 186*a* has an angle in relation to the axis of rotation 24*a* which is larger than the angle of the guide segment 184*a* in relation to the axis of rotation 24*a*. In particular, the portions of the ejector segment 182*a*, the guide segment 184, the further guide segment 186*a* and the base portion 180*a* and the portion, forming the mating surface, of one of the main shells 46*a*, 48*a* are formed integrally with one another.

Figure 6:
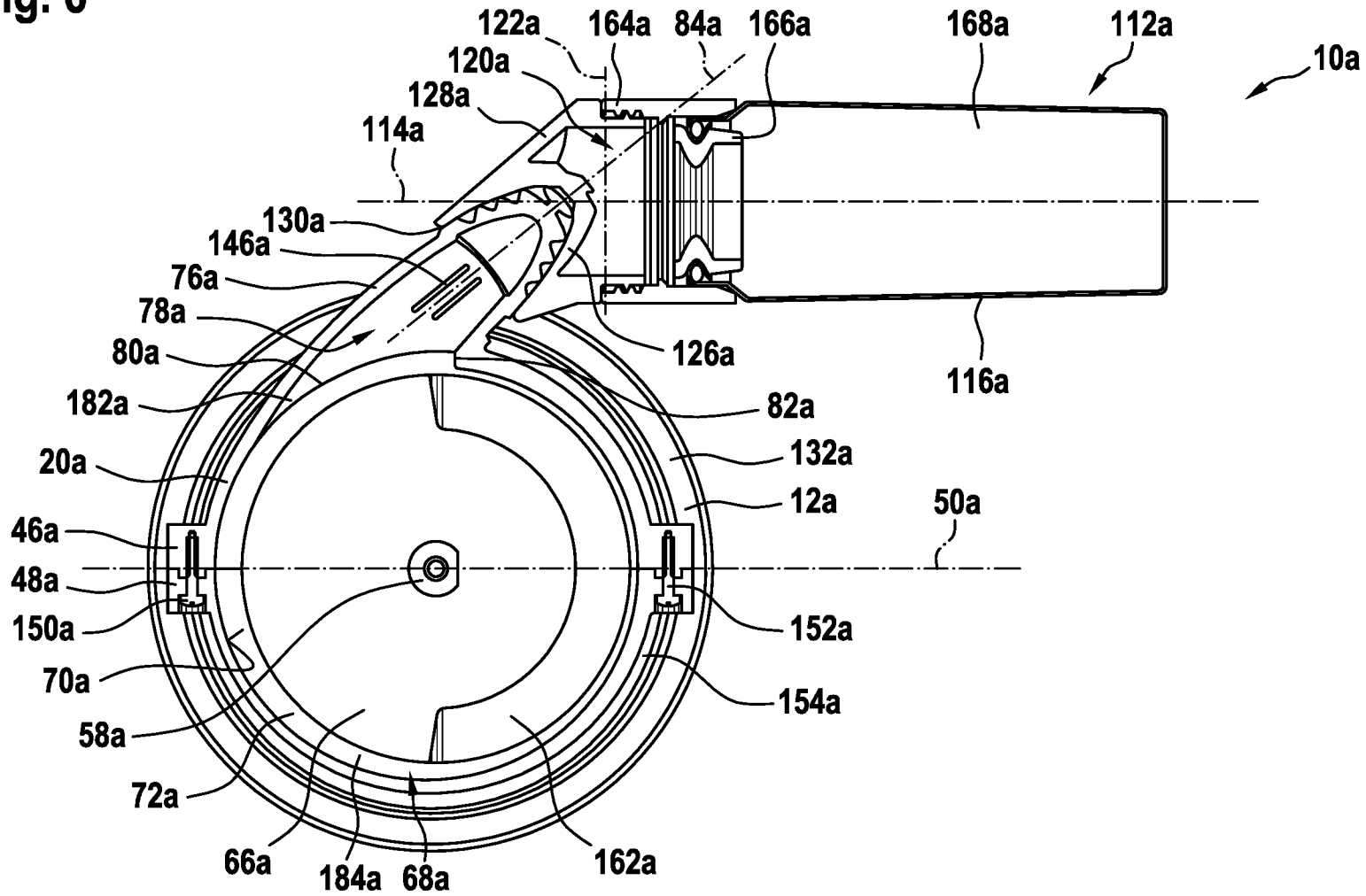
FIG. 6 shows a schematic cross section of the connecting housing unit.

The connecting housing unit 20*a* has a conical spiral track 72*a* arranged on the inner wall 70*a*. The spiral track 72*a* leads in particular from the air inlet 74*a* of the connecting housing unit 20*a* in a direction of the axis of rotation 24*a* to the ejector port 76*a* of the connecting housing unit 20*a*. In particular, the conical spiral track 72*a* is arranged in the guide segment 184*a*. FIG. 6 shows a cross section, perpendicular to the axis of rotation 24*a*, through the ejector segment 182*a*. The fan receiving region 68*a* preferably has an asymmetrical form. On account of the spiral track 72*a*, in a plane which is perpendicular to the axis of rotation 24*a*, the inner wall 70*a* has in particular a spacing from the axis of rotation 24*a* which is dependent on an angular position with respect to the axis of rotation 24*a*. The mouth opening 78*a* of the ejector port 76*a*, together with the inner wall 70, in particular forms a separating edge 82*a*, which runs at least substantially parallel to the axis of rotation 24*a*. The spacing between the inner wall 70*a* and the axis of rotation 24*a* is at its smallest at the separating edge 82*a*. The spacing between the inner wall 70*a* and the axis of rotation 24*a* preferably increases continuously or remains constant in sections. The spacing between the inner wall 70*a* and the axis of rotation 24*a* particularly preferably increases linearly with an angular difference in relation to an angular position of the separating edge 82*a*, illustrated here in particular in the clockwise direction. The spiral track 72*a* is optionally formed in only one of the main shells 48*a*, while the spacing of the guide segments 184*a* is kept constant in sections in the main shell 46*a* with the ejector port 76*a*. The conical spiral track 72*a* preferably has a pitch parallel to the axis of rotation 24*a* with which the spiral track 72*a* in at most one revolution, preferably a half-revolution, leads from the further guide segment 186*a* to the mouth opening 78*a*. The guide segment 184*a*, forming the spiral track 72*a*, of the inner wall 70*a* has an angle of between 25 and 40°, preferably between 30° and 35°, in relation to the axis of rotation 24*a* in a plane which encompasses the axis of rotation 24.

The spiral track 72*a*, in particular the guide segment 184*a*, in a projection along the axis of rotation 24*a* preferably has no overlap with the fan 66*a*. More than 50%, in particular more than 75%, preferably more than 90%, of the further guide segment 184*a* in a projection along the axis of rotation 24*a* is arranged inside the fan 66*a*. The blading of the fan 66*a* has a bevel 86*a* (see FIG. 3). The bevel 86*a* is arranged transversely to the axis of rotation 24*a* and at least substantially parallel to the further guide segment 186*a* of the inner wall 70*a*. The inner wall 70*a* in the further guide segment 186*a* and in particular the bevel 86*a* preferably has an angle in relation to the axis of rotation 24*a* in a plane which encompasses the axis of rotation 24*a* of between 50° and 70°, in particular between 55° and 65°.

A further separating edge 80*a*, which is formed by the mouth opening 78*a* of the ejector port 76*a* of the connecting housing unit 20*a*, runs at least substantially perpendicularly to the axis of rotation 24*a*. In particular, the further separating edge 80*a* separates the ejector segment 182*a* from the guide segment 184*a*. The further separating edge 80*a* continues in particular the spiral path 72*a* in the region of the mouth opening 78*a* as far as the separating edge 82*a* with a constant spacing from the axis of rotation 24*a*. The further separating edge 80*a* is arranged in particular at a height along the axis of rotation 24*a* between the base plate of the fan 66*a* and the termination plane of the blading. The separating edge 82*a*, which is formed by the mouth opening 78*a* of the ejector port 76*a* of the connecting housing unit 20*a* and runs at least substantially parallel to the axis of rotation 24*a*, has a tapering form and has a radius of curvature of less than 10 mm, preferably of less than 3 mm, particularly preferably of less than 2 mm. The radius of curvature of the separating edge 82*a* is in particular in a plane which is perpendicular to the axis of rotation 24*a*. The radius of curvature of the separating edge 82*a*, in particular independently of a precise shaping of the separating edge 82*a*, describes a smallest imaginary circle, which rests against both the inner wall 70*a* which faces the fan 66*a* and an inner wall of the ejector port 76*a*. Tangents which rest against the inner wall 70*a* and the inner wall of the ejector port 76*a* preferably form an angle of between 45° and 65°, preferably between 55° and 60°, in a plane which is perpendicular to the axis of rotation 24*a*.

The channel longitudinal axis 84*a* runs centrally through an ejector port 76*a* and predefines in particular a main flow direction of air through the ejector port 76*a*. A projection of the channel longitudinal axis 84*a* along the axis of rotation 24*a* preferably rests tangentially against the fan 66*a* on an outer contour thereof. The projection of the channel longitudinal axis 84*a* along the axis of rotation 24*a* preferably forms an angle of between 40° and 50°, particularly preferably between 44° and 46°, in relation to the assembly plane 50*a*. An inner wall, situated opposite the separating edge 82*a*, of the ejector port 76*a* extends preferably from the assembly plane 50*a* to an ejector opening of the ejector port 76*a*, wherein a spacing between this inner wall and the axis of rotation 24*a* in the assembly plane 50*a* is matched to the spacing of the spiral track 72*a* and becomes continuously greater in the direction of the ejector opening. The channel longitudinal axis 84*a* of the ejector port 76*a* of the connecting housing unit 20*a* forms an acute angle, in particular between 15° and 35°, preferably between 20° and 30°, with a plane which is perpendicular to the axis of rotation 24*a*. The channel longitudinal axis 84*a* is inclined away from the grinding device 12*a* in a direction of the axis of rotation 24*a*, in particular proceeding from the mouth opening 78*a*. At the mouth opening 78*a*, the ejector port 76*a* has in particular a rectangular cross section perpendicular to the channel longitudinal axis 84*a*. At the ejector opening, the ejector port 76*a* preferably has a circular cross section perpendicular to the channel longitudinal axis 84*a*. A protective device 146*a*, in particular in the form of webs parallel to the channel longitudinal axis 84*a*, for preventing a finger and/or other foreign bodies from entering the ejector port 76*a* is preferably arranged in a portion of the ejector port 76*a* that has the rectangular cross section.

In particular, the material collection device 116*a* is arranged on the region of the ejector port 76*a* with the circular cross section. The material collection container 112*a* has at least one opening 120*a* for feeding the material into the material collection container 112*a*. The opening 120*a* of the material collection container 112*a* is arranged in an opening plane 122*a*. The opening plane 122*a* preferably can be aligned at least substantially perpendicularly to the longitudinal axis 92*a* in at least one state of the material collection device 116*a* in which it is arranged at the ejector port 76*a*. The material collection container 112*a* preferably comprises exactly one opening 120*a* in the opening plane 122*a*. As an alternative, the material collection device 116*a* in the opening plane 122*a* comprises a structural element, which divides the opening 120*a* into small partial openings. The container longitudinal axis 114*a* of the material collection container 112*a* is aligned at least substantially perpendicularly to the opening plane 122*a*. In particular, the container longitudinal axis 114*a* is in the form of a container center axis, which runs in particular through a geometric center of gravity of the material collection container 122*a*. In particular, the material collection container 112*a* has the largest longitudinal extent parallel to, in particular along, the container longitudinal axis 114*a*. In particular, the material collection container 112*a* has a rotationally symmetrical form about the container longitudinal axis 114*a*.

Figure 7:
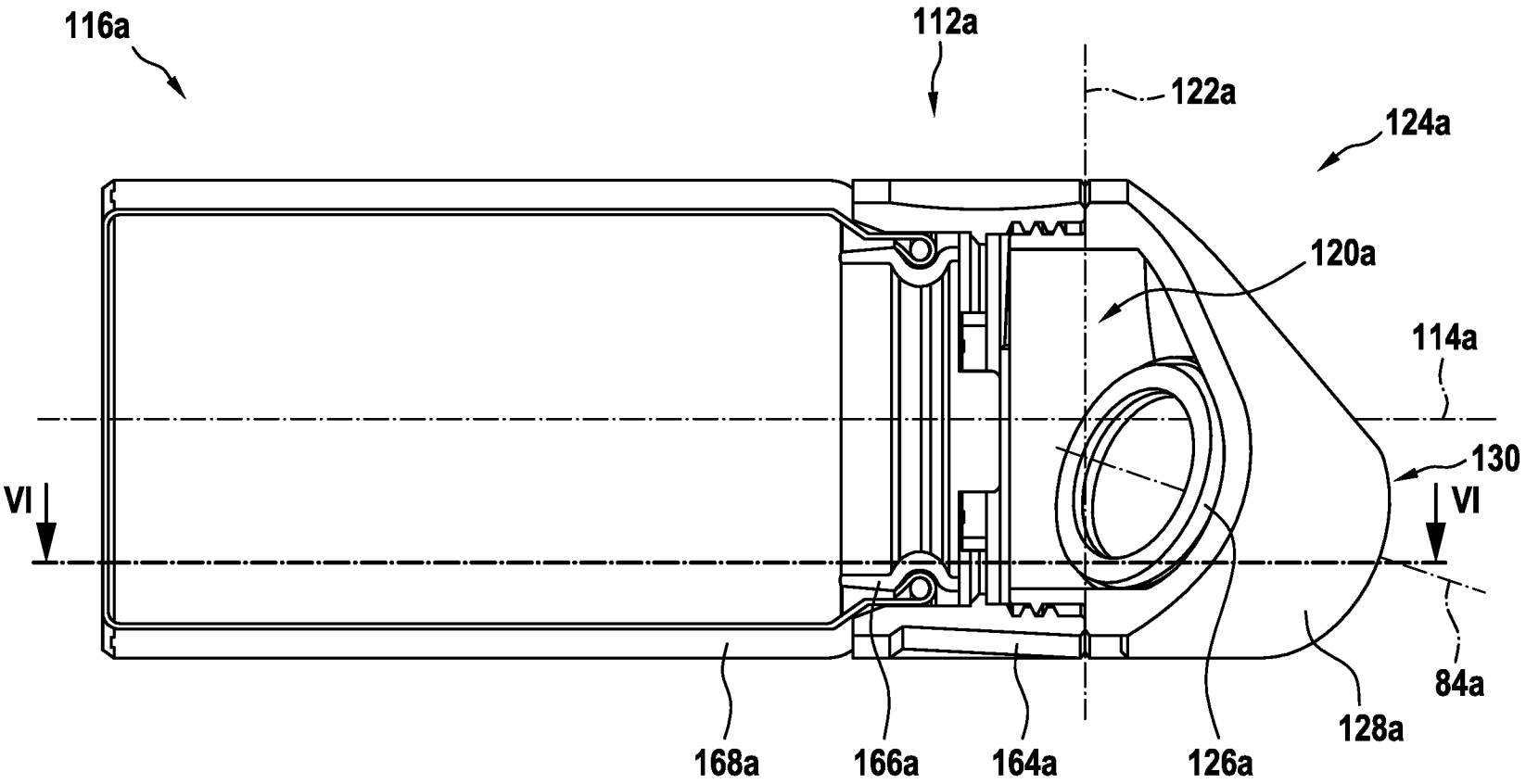
FIG. 7 shows a schematic longitudinal section of a material collection device of the hand-held grinding machine according to the disclosure.

The material collection device 116*a* comprises at least one assembly unit 124*a* for assembling the material collection container 112*a* on the hand-held grinding machine 10*a*. The assembly unit 124*a* comprises a channel element 126*a* for connection to the ejector port 76*a* of the hand-held grinding machine 10*a*. The channel element 126*a* is provided in particular to be arranged concentrically at the ejector port 76*a* and has the same channel longitudinal axis 84*a* as the ejector port 76*a* in a state in which it is arranged on the ejector port 76*a*. The channel longitudinal axis 84*a* of the channel element 126*a* is arranged transversely to the opening plane 122*a* of the material collection container 112*a* in at least one sectional plane running perpendicularly to the opening plane 122*a*. The channel longitudinal axis 84*a* is arranged transversely to the opening plane 122*a* in a further sectional plane which is perpendicular to the sectional plane and the opening plane 122*a*. In particular, the channel longitudinal axis 84*a* and the container longitudinal axis 114*a* are arranged in a skewed manner. The sectional plane in a configuration shown perpendicularly to the axis of rotation 24*a* can be seen in FIG. 6. FIG. 7 shows the further sectional plane, which is illustrated here in particular offset to the container longitudinal axis 114*a*. In the state of the material collection device in which it is assembled on the hand-held grinding machine, the container longitudinal axis 114*a* can be aligned at least substantially parallel to the assembly plane 50*a*, in particular wherein the container longitudinal axis 114*a* is aligned parallel to the longitudinal axis 92*a*. When the container longitudinal axis 114*a* is aligned parallel to the longitudinal axis 92*a*, the further sectional plane is arranged in particular parallel to the assembly plane 50*a*. The container longitudinal axis 114*a* of the material collection container 112*a* forms, relative to the assembly plane 50*a*, an angle which, when added to an angle between the channel longitudinal axis 84*a* and the container longitudinal axis 114*a*, forms a total angle of between 80° and 100°, particularly preferably of 90°. In particular, the channel longitudinal axis 84*a* intersects the opening plane 122*a* in the sectional plane at an angle of between 40° and 50°, preferably between 44° and 46°. In particular, the channel longitudinal axis 84*a* intersects the opening plane 122*a* in the further sectional plane at an angle of between 15° and 30°.

The channel element 126*a* is preferably plugged onto the ejector port 76*a* along the channel longitudinal axis 84*a*. An inner wall of the channel element 126*a* and/or an outer wall of the ejector port 76*a* preferably has structural elements for the purpose of a force fit, which in particular can be released and established by hand, of the channel element 126*a* with the ejector port 76*a*, for example webs or nubs with an interference fit and/or a sheathing with an elastic material or the like. The material collection device 116*a* is preferably arranged on the ejector port 76*a* such that it can rotate, in particular at least with a moderate expenditure of force. In particular, the moderate expenditure of force necessary for rotating the material collection device 116*a* at the ejector port 76*a* exceeds a weight of the material collection device 116*a*, in particular in a state of the material collection container 112*a* in which it is filled with material removed by the grinding device 12*a*. The moderate expenditure of force can preferably be applied by a hand without a tool, and is in particular smaller than 200 N, preferably smaller than 125 N, particularly preferably smaller than 75 N. In particular, the material collection device 116*a* remains in a current rotational position with respect to the ejector port 76*a* without manual actuation. A rotation of the material collection device 116*a* about the channel longitudinal axis 84*a* causes a relative position of the container longitudinal axis 114*a* in relation to the axis of rotation 24*a* and/or of the longitudinal axis 92*a* to change. In particular, the material collection device 116*a* is arranged pivotably on the ejector port 76*a* relative to the drive housing 16*a*. This makes it possible to advantageously flexibly align the material collection device 116*a* during the grinding operation such that even surfaces which are difficult to access can be processed.

The assembly unit 124*a* comprises an adapter housing 128*a*. The adapter housing 128*a* has an asymmetrically tapering form from the opening plane 122*a* in a direction of the channel longitudinal axis 84*a*. The channel element 126*a* projects at least partially into the adapter housing 128*a*. The channel element 126*a* has an in particular rotationally symmetrical form in relation to the longitudinal axis 92*a*. The channel element 126*a* is preferably recessed completely in the adapter housing 128*a*. The channel element 126*a* and the adapter housing 128*a* are particularly preferably formed in one piece. The adapter housing 128*a* preferably has an assembly element for fixing the material collection container 112*a* to the adapter housing 128*a*. For example, the assembly element is in the form of a thread, preferably an external thread. In particular, the material collection container 112*a* has an air-permeable container region 168*a* for collecting the removed material and a fastening ring 164*a* for fastening the container region 168*a* to the assembly unit 124*a*. The fastening ring 164*a* preferably has an assembly element, for example a thread, in particular an internal thread, for connection to the adapter housing 128*a*.

The container region 168*a* is preferably fixed to the fastening ring 164*a* by means of a latching and/or screw connection 166*a*. In particular, the fastening ring 164*a* delimits the opening 120*a*. The fastening ring 164*a* and the adapter housing 128*a* are preferably arranged at least substantially flush with one another. The adapter housing 128*a* is in particular in the form of a truncated cone which rests on the fastening ring 164*a* in a skewed manner and the cone axis of which is aligned coaxially with the channel longitudinal axis 84*a*. A radius of a top surface of the frustoconical adapter housing 128*a* is preferably the same as an outer radius of the channel element 126*a*.

A maximum adapter longitudinal extent of a portion of the assembly unit 124*a* that projects beyond the material collection container 112*a* in a direction of the container longitudinal axis 114*a* is at least substantially the same as a maximum adapter transverse extent of the assembly unit 124*a* in the opening plane 122*a*. In particular, a ratio of the adapter longitudinal extent to the adapter transverse extent is between 50% and 80%, preferably between 60% and 70%. In particular, the adapter housing 128*a*, in particular an inlet opening 130*a* of the channel element 126*a*, projects at most slightly beyond the material collection container 112*a* in a projection along the container longitudinal axis 114*a*. In particular, a projection of the adapter housing 128*a* along the container longitudinal axis 114*a* is completely inside a smallest imaginary square which specifically completely encloses a projection of the material collection container 112*a*. In particular, a maximum distance of the inlet opening 130*a* from the container longitudinal axis 114*a* is smaller than $\sqrt{2}$ times an outer radius of the material collection container 112*a* in the opening plane 122*a*. In FIG. 6, the material collection container 112*a* is divided by the sectional plane in a ratio of more than 1:4, and therefore here the diameter of the material collection container 112*a* is not illustrated and the adapter housing 128*a* only seemingly projects significantly beyond the material collection container 112*a* in the direction of the grinding device 12*a*.

The outlet opening of the channel element 126*a* assumes a maximum outlet opening width between 35% and 55%, in particular between 44% and 47%, of a maximum opening width of the opening 120*a* in the opening plane 122*a*. A ratio of an internal diameter of the channel element 126*a* compared to the opening width of the opening 120*a* preferably amounts to between 35% and 60%, preferably between 45% and 55%. The container longitudinal axis 114*a* preferably runs through an outlet opening, facing the material collection container 112*a*, of the channel element 126*a*. The outlet opening in the channel element 126*a* is preferably arranged in a plane which runs at least substantially perpendicularly to the channel longitudinal axis 84*a* and transversely to the opening plane 122*a*. A geometric center point of the outlet opening in the channel element 126*a* is arranged offset at least in the further sectional plane in particular with respect to the container longitudinal axis 114*a*, in particular by a magnitude of 10% to 30% of the maximum opening width.

The inlet opening 130*a* of the channel element 126*a* extends in a plane which runs at least substantially perpendicular to the channel longitudinal axis 84*a* and in particular transversely to the opening plane 122*a*. The inlet opening 130*a* engages in particular around the region of the ejector port 76*a* with the circular cross section. The ejector port 76*a* preferably projects into the channel element 126*a* at least as far as the container longitudinal axis 114*a*. The inlet opening 130*a* in the channel element 126*a* is arranged spaced apart from the container longitudinal axis 114*a*, running perpendicularly to the opening plane 122*a*, of the material collection container 112*a*.

Figure 8:
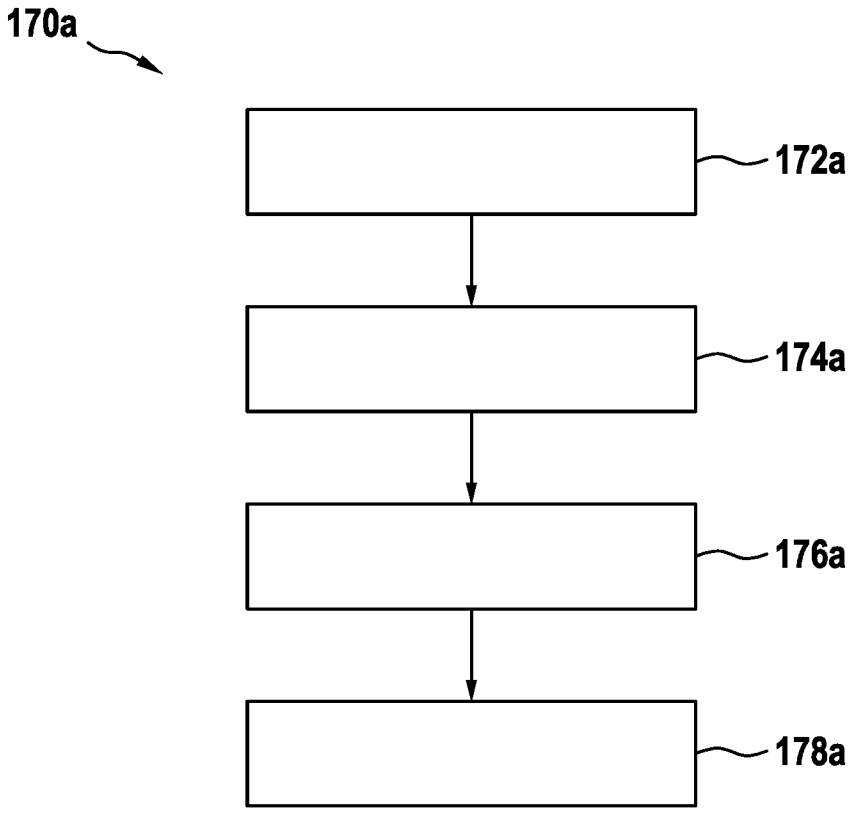
FIG. 8 shows a schematic flow diagram of a method according to the disclosure for assembling the hand-held grinding machine according to the disclosure.

FIG. 8 shows a flow diagram of a method 170*a* for assembling the hand-held grinding machine 10*a*. The method 170*a* comprises in particular a preassembly step 172*a*. The method 170*a* preferably comprises a connection step 174*a*. The method 170*a* preferably comprises a main-shell arrangement step 176*a*. In particular, the method 170*a* comprises a fixation step 178*a*. In the preassembly step 172*a*, in particular the drive device 14*a* and/or the grinding device 12*a* are preassembled, in particular independently of one another. In the preassembly step 172*a*, the drive device 14*a* is arranged in the drive housing 16*a*, in particular in a half-shell to be assembled of the drive housing 16*a*, of the hand-held grinding machine 10*a*. In the connection step 174*a*, the gear mechanism element 58*a* is preferably pressed onto the drive shaft 26*a*. In the connection step 174*a*, the grinding device 12*a* is preferably screwed on the gear mechanism element 58*a*. In the main-shell arrangement step 176*a*, a form fit, parallel to the axis of rotation 24*a*, of the connecting housing unit 20*a* with the docking interface 22*a* is formed by means of the axial form-fitting element 28*a*, 29*a*, 30*a*, 32*a*, arranged in the fixing plane 27*a*, of the docking interface 22*a*. In the main-shell arrangement step 176*a*, the connecting housing unit 20*a* is arranged on the docking interface 22*a* so as to engage around the docking interface 22*a* in the fixing plane 27*a* which is perpendicular to the axis of rotation 24*a*. In particular, in the main-shell arrangement step 176*a*, the main shells 46*a*, 48*a* are placed on the docking interface 22*a*. In particular, the mating surfaces of the main shells 46*a*, 48*a* are placed onto the contact surface 52*a*, wherein the grinding device 12*a* is arranged at least partially in the connecting housing unit 20*a*. In the main-shell arrangement step 176*a*, the sleeve of the main shells 46*a*, 48*a* is preferably plugged in the fixing recesses 34*a*, 36*a* in the docking interface 22*a*. The main shells 46*a*, 48*a* are placed against one another in particular in the assembly plane 50*a*. In the fixation step 178*a*, the separately formed fixing element 42*a*, 44*a* is arranged in the sleeve arranged in the fixing recess 34*a*, 36*a* and as a result presses the main shells 46*a*, 48*a* against one another and, in particular the contact surface 52*a*, against the docking interface 22*a*. The fixing elements 42*a*, 44*a*, the additional fixing elements 150*a*, 152 and optionally drive housing fixing elements for connecting the half-shells to be assembled of the drive housing 16*a* are preferably assembled on the main shells 46*a*, 48*a*, the docking interface 22*a* and/or the drive housing 16*a* in all cases from the same, single direction which is at least substantially perpendicular to the assembly plane 50*a*.

FIGS. 9 to 14 show further exemplary embodiments of the disclosure. The following description and the drawings are substantially restricted to the differences between the exemplary embodiments, it being possible to make reference fundamentally also to the drawings and/or the description of the other exemplary embodiments, in particular in FIGS. 1 to 8, with respect to components with the same designation, in particular with respect to components with the same reference signs. In order to make a distinction between the exemplary embodiments, the letter a is appended to the reference signs of the exemplary embodiment in FIGS. 1 to 8. The letter a is replaced by letters b to d in the exemplary embodiments in FIGS. 9 to 14.

Figure 9:
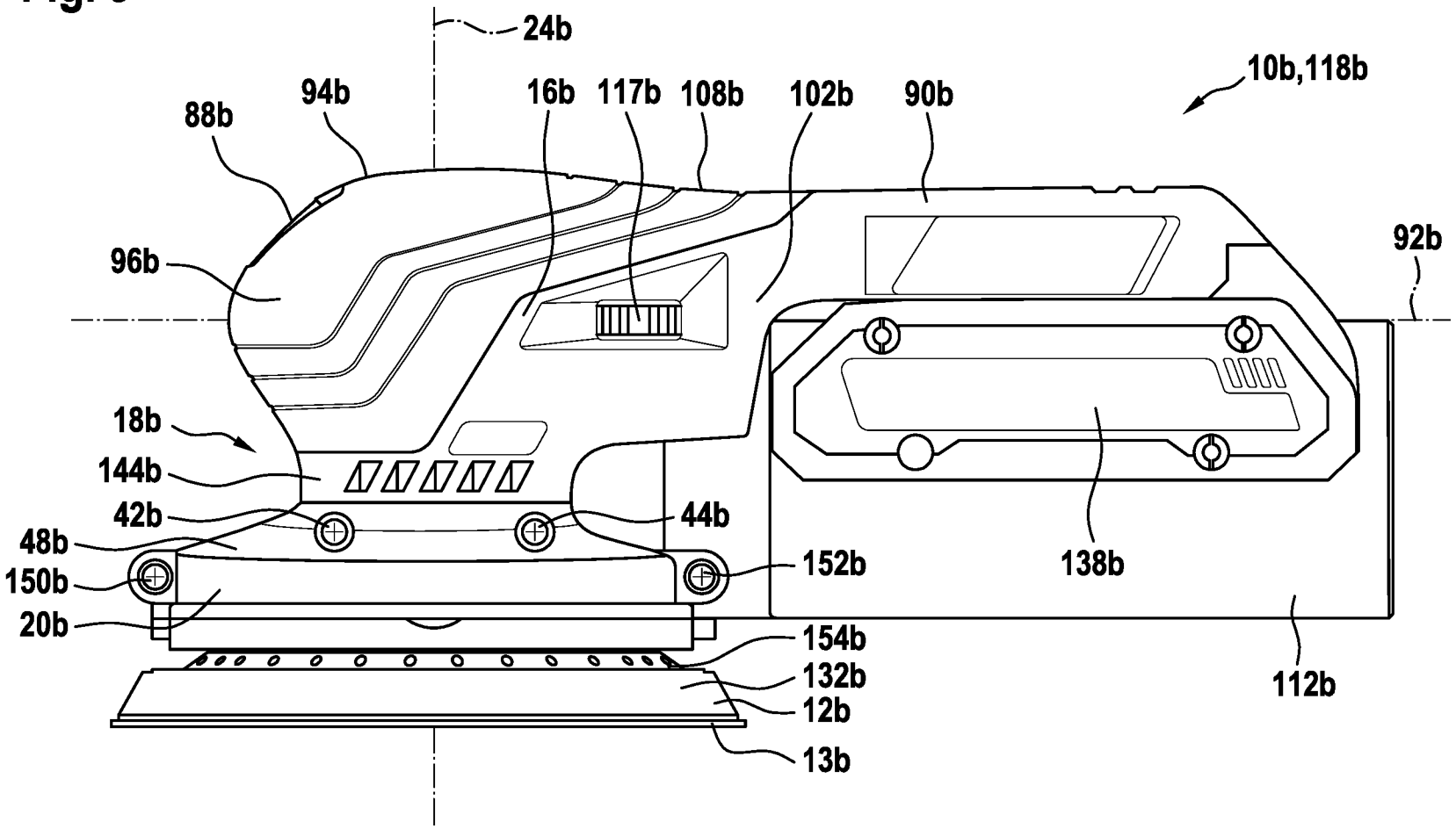
FIG. 9 shows a schematic illustration of an alternative configuration of a hand-held grinding machine according to the disclosure with an alternative drive device.
Figure 10:
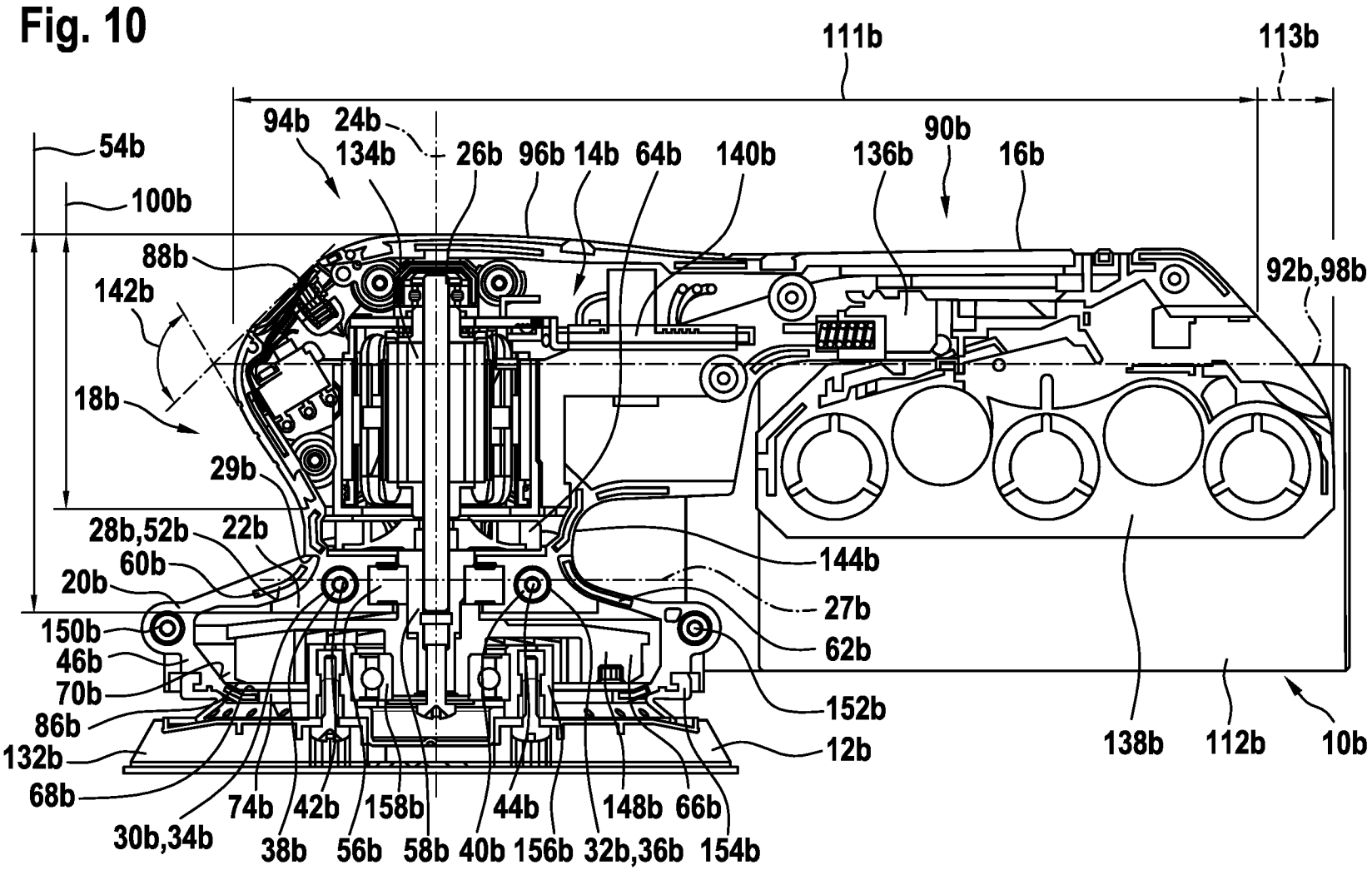
FIG. 10 shows a schematic longitudinal section of the alternative configuration.

FIG. 9 shows an external view and FIG. 10 shows a longitudinal section of a hand-held grinding machine 10*b* in the form of an eccentric grinder. The hand-held grinding machine 10*b* comprises a grinding device 12*b*, which is in particular identical to the grinding device 12*a* of the previous exemplary embodiment. The hand-held grinding machine 10*b* has a drive device 14*b*, in particular with an electric motor 134*b*. In particular, the electric motor 134*b* incorporates a rated voltage of 18 volts. An electrical power supply interface 136*b* of the drive device 14*b* and a longitudinal-axis portion 90*b* of a drive housing 16*b* of the hand-held grinding machine 10*b* is preferably designed for receiving an 18-volt rechargeable battery pack 138*b*. The hand-held grinding machine 10*b* comprises an interface device 18*b* with a docking interface 22*b* and a connecting housing unit 20*b*. The connecting housing unit 20*b* preferably has a counterbalance, which compensates a torque caused by a weight of the rechargeable battery pack 138*b*, in particular in order to prevent an axis of rotation 24*b* of the drive device 14*b* from tilting. The counterbalance is preferably arranged on main shells 46*b*, 48*b* of the connecting housing unit 20*b*, in particular is integrated therein. The main shells 46*b*, 48*b* are optionally manufactured from metal in order to form the counterbalance, in particular by means of an aluminum/zinc die-casting process. As an alternative, the main shells 46*b*, 48*b* have metal inclusions in a plastic body as counterbalance. The counterbalance and the electrical power supply interface 136*b* are arranged in particular on different sides of a plane which is perpendicular to a longitudinal axis 92*b* of the hand-held grinding machine 10*b* and contains the axis of rotation 24*b*. A portion of the connecting housing unit 20*b* with the counterbalance preferably rests against a docking interface 22*b* of the interface device 18*b*. In particular, the portion of the connecting housing unit 20*b* with the counterbalance has a greater wall thickness than the portion of the connecting housing unit 20*b* that is arranged on the side situated opposite the plane which is perpendicular to the longitudinal axis 92*b* and encompasses the axis of rotation 24*b*. The portion of the connecting housing unit 20*b* with the counterbalance preferably has an outer surface which faces the drive housing 16*b* and is inclined in the direction of the grinding device 12*b* by 15° to 30° with respect to a plane which is perpendicular to the axis of rotation 24*b*. Reference should be made to FIGS. 1 to 8 and the description thereof in terms of further features of the hand-held grinding machine 10*b*.

Figure 11:
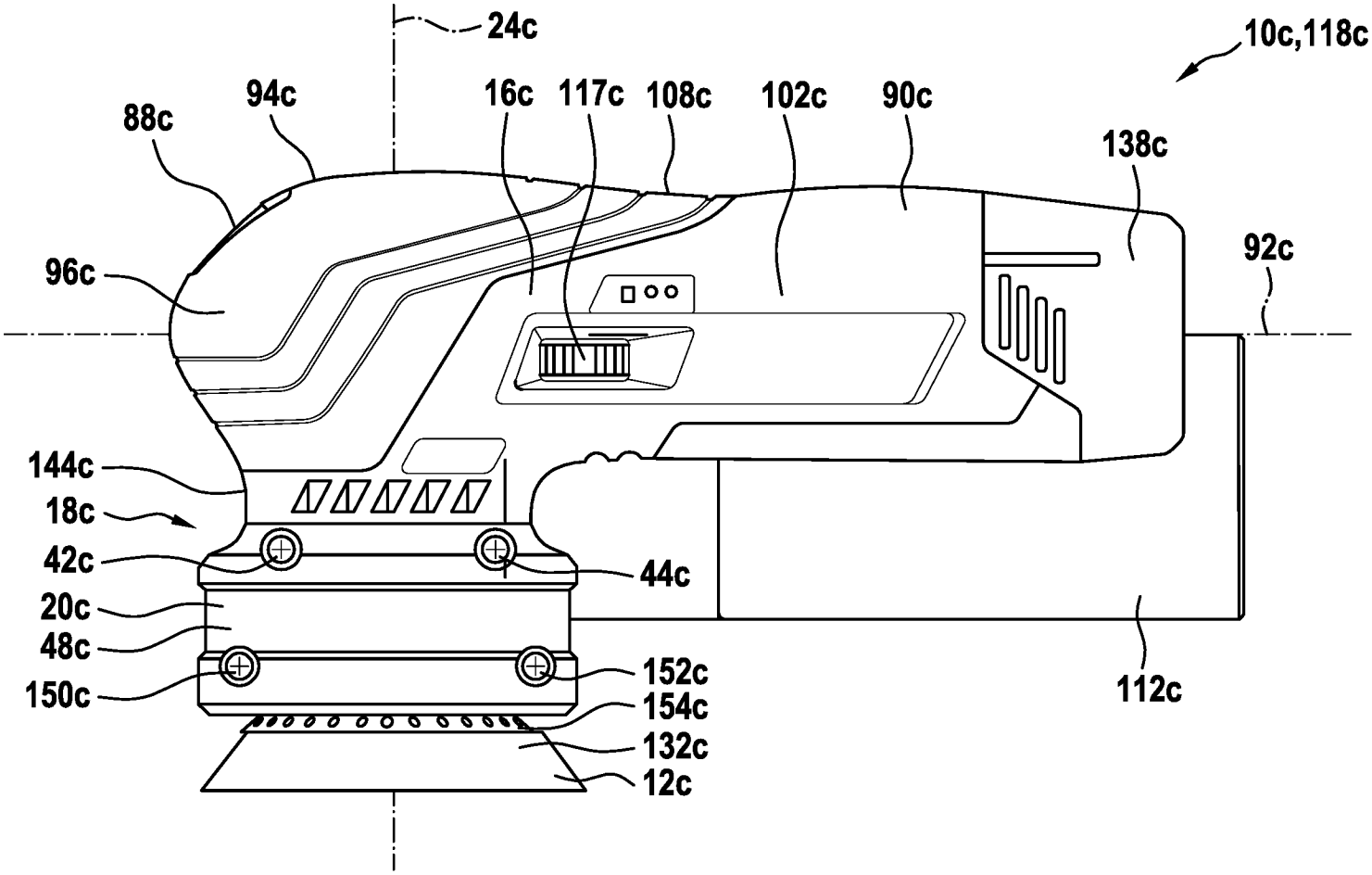
FIG. 11 shows a schematic illustration of a further alternative configuration of a hand-held grinding machine according to the disclosure with an alternative grinding device.
Figure 12:
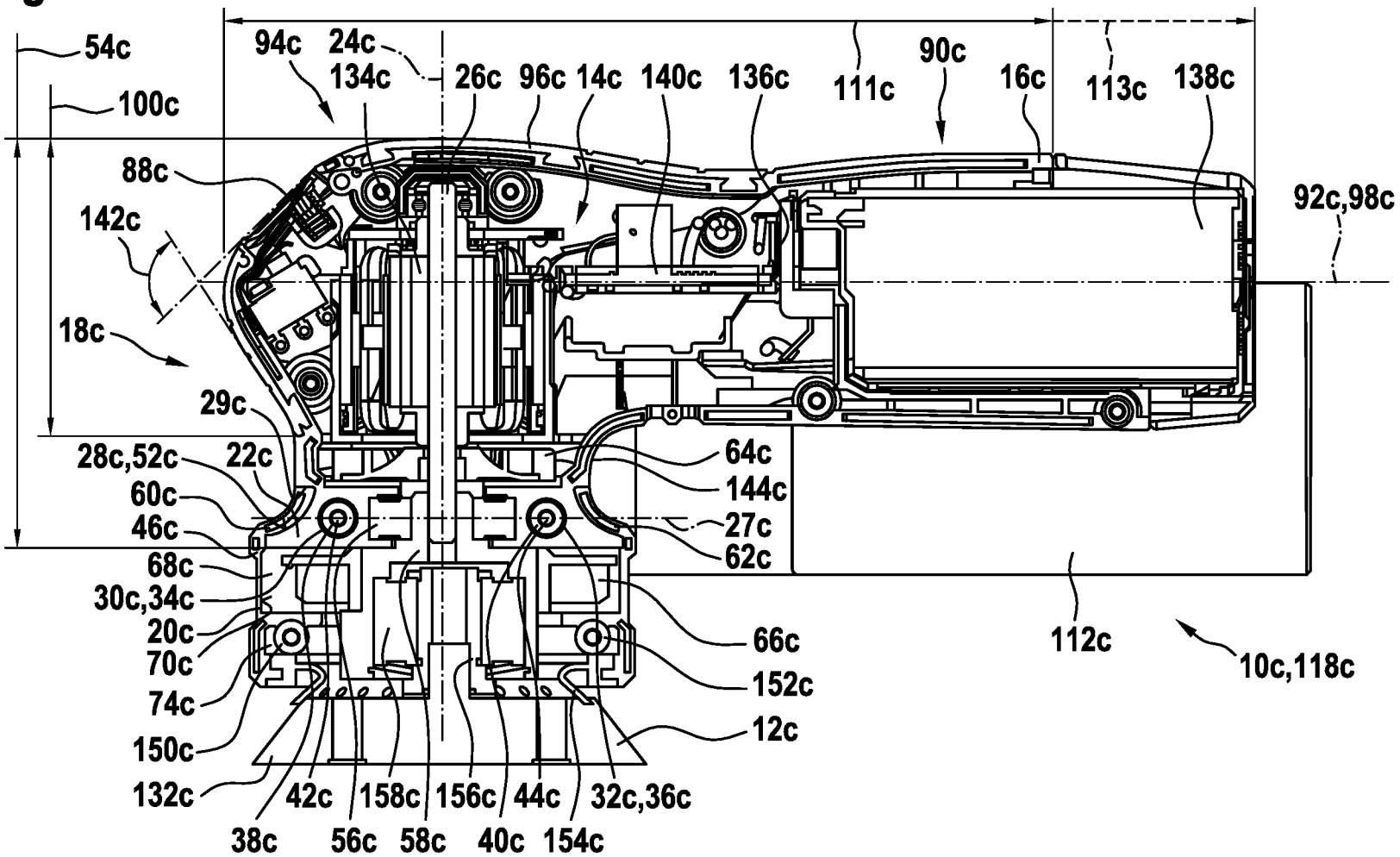
FIG. 12 shows a schematic longitudinal section of the further alternative configuration.

FIG. 11 shows an external view and FIG. 12 shows a longitudinal section of a hand-held grinding machine 10*c*. The hand-held grinding machine 10*c* has a drive device 14*c* and a drive housing 16*c*, which are formed in particular identically to the drive device 14*a* and the drive housing 16*a*, respectively, of the first exemplary embodiment. As an alternative, a grinding device 12*c* of the hand-held grinding machine 10*c*, in particular without further adaptation, may also be combined with a drive device and a drive housing 16*c*, as were shown in the second exemplary embodiment. A grinding pad 132*c* of the grinding device 12*c* has a diameter of between 70 mm and 80 mm, preferably between 77 mm and 80 mm, for example. In particular, the entire grinding device 12*c* and an interface device 18*c* of the hand-held grinding machine 10*c* in a projection along an axis of rotation 24*c* of the drive device 14*c* lie inside the drive housing 16*c*. A docking interface 22*c* of the interface device 18*c* is formed in particular identically to the docking interfaces 22*a*, 22*b* of the previous exemplary embodiments. A connecting housing unit 20*c* of the interface device 18*c* is adapted in particular to a height of the grinding device 12*c* parallel to the axis of rotation 24*c*. A maximum transverse extent of the connecting housing unit 20*c* perpendicular to the axis of rotation 24*c* is preferably insignificantly larger than a maximum transverse extent of the docking interface 22*c*, in particular is larger only by a wall thickness, in particular twice the wall thickness, of the connecting housing unit 20*c*. In particular, a portion of the connecting housing portion 20*c* that runs at least substantially parallel to the axis of rotation 24*c* is arranged directly on the docking interface. In particular, additional fixing elements 150*c*, 152*c* are arranged in a plane parallel to the axis of rotation 24*c* with a contact surface 52*c* of the docking interface 22*c*. A gear mechanism element 58*c* of the interface device 18*c* engages through an optional fan 66*c* along the axis of rotation. In particular, the gear mechanism element 58*c* is formed integrally with an eccentric of the grinding device 12*c* to form a drive of the grinding pad 132*c*. The gear mechanism element 58*c* engages around an eccentric bearing 158*c* of the grinding device 12*c*, in particular in a plane which is perpendicular to the axis of rotation 24*c*. The eccentric bearing 158*c* preferably engages around a grinding-pad holder 156*c* of the grinding device 12*c* in a plane which is perpendicular to the axis of rotation 24*c*. The grinding-pad holder 156*c* receives in particular a continuation of the grinding pad 132*c* in a direction parallel to the axis of rotation 24*c*. Reference should be made to FIGS. 1 to 10 and the description thereof in terms of further features of the hand-held grinding machine 10*c*.

Figure 13:
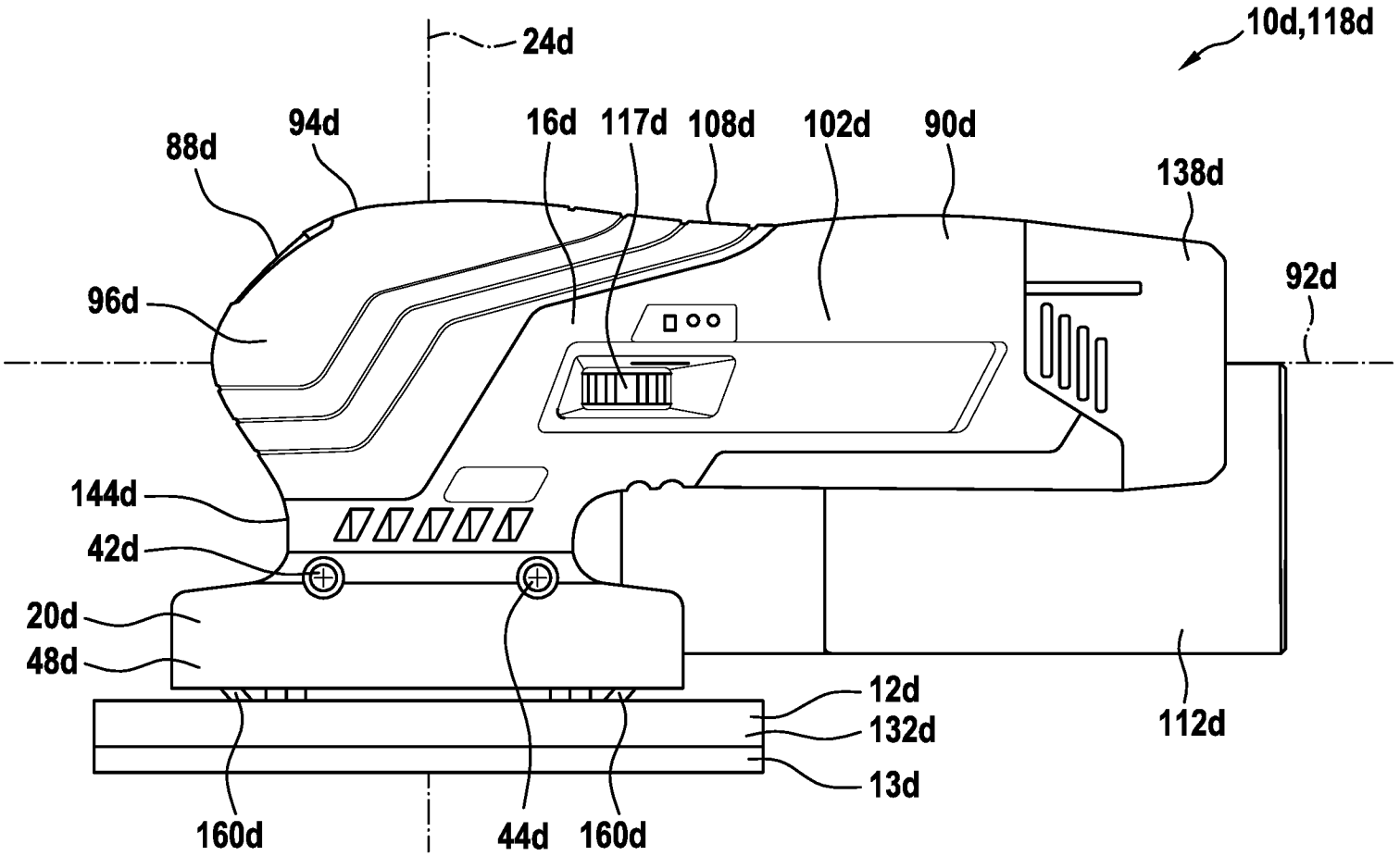
FIG. 13 shows a schematic illustration of a further alternative configuration of a hand-held grinding machine according to the disclosure with a further alternative grinding device.
Figure 14:
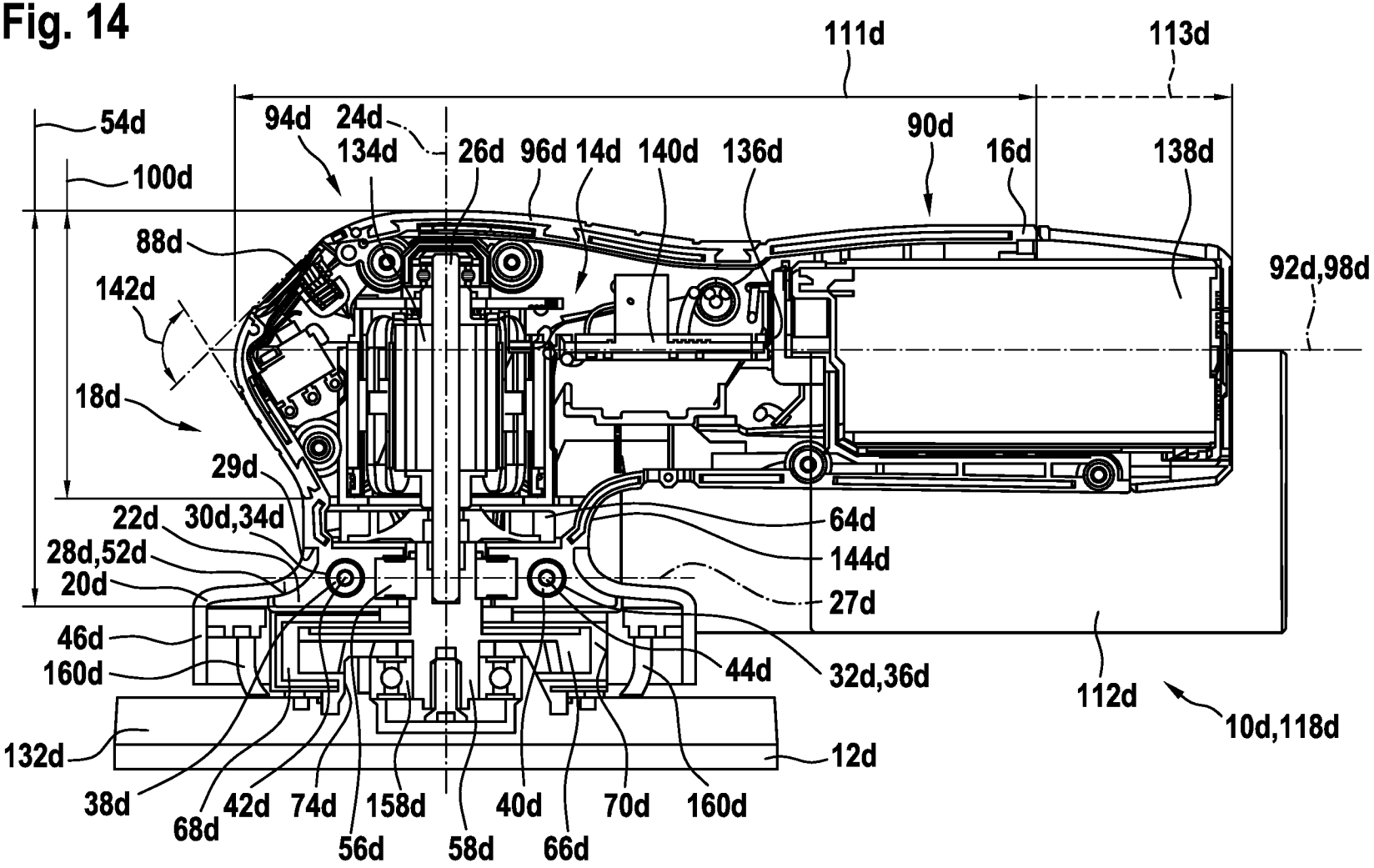
FIG. 14 shows a schematic longitudinal section of the additional alternative configuration.

FIG. 13 shows an external view and FIG. 14 shows a longitudinal section of a hand-held grinding machine 10*d*. The hand-held grinding machine 10*d* is in the form in particular of an oscillating grinder. The hand-held grinding machine 10*d* has a drive device 14*d* and a drive housing 16*d*, which are formed in particular identically to the drive device 14*a* and the drive housing 16*a*, respectively, of the first exemplary embodiment. As an alternative, a grinding device 12*d* of the hand-held grinding machine 10*d*, in particular without further adaptation, may also be combined with a drive device and a drive housing, as are shown in the second exemplary embodiment. A grinding pad 132*d* of the grinding device 12*d* is fastened to a connecting housing unit 20*d* of an interface device 18*d* of the hand-held grinding machine 10*d*, in particular by means of an elastic mount 160*d*. A fan

66*d* of the grinding device 12*d* is arranged in a fan housing of the grinding device 12*d*, which is arranged in particular inside the connecting housing unit 20*d*. The elastic mount 160*d* is arranged in particular between the fan housing and the connecting housing unit 20*d*. A gear mechanism element 58*d* of the interface device 18*d* is preferably formed integrally with an eccentric of the grinding device 12*d*. An eccentric bearing 158*d* of the grinding device 12*d* engages in particular around the gear mechanism element 58*d* in a plane which is perpendicular to an axis of rotation 24*d* of the drive device 14*d*. The eccentric bearing 158*d* is arranged in particular in a guide ring, able to be deflected by the eccentric bearing 158*d*, of the grinding pad 132*d* and connected to the guide ring preferably in a force-fitting manner. Reference should be made to FIGS. 1 to 12 and the description thereof in terms of further features of the hand-held grinding machine 10*d*.

As used herein, the held-held grinding machine 10*a*, 10*b*, 10*c*, 10*d* is also referred to as a hand-held sander, a hand-held sanding machine, an eccentric sander, and an oscillating sander. The grinding device 12*a*, 12*b*, 12*c*, 12*d* is also referred to as a sanding device, and the grinding means 13*a* is also referred to as a sanding means. The grinding pad 132*a*, 132*c*, 132*d* is also referred to herein as a sanding pad. Accordingly, the ejection port 76*a* is configured for ejecting material that has been worn off during a sanding process and a sanding operation. The grinding -pad holder 156*a*, 156*c* is also referred to herein as a sanding-pad holder.

The invention claimed is:

1. A hand-held sanding machine, comprising:

at least one sanding device configured to receive or form a sanding apparatus;

a drive device configured to drive the at least one sanding device;

at least one actuating element configured to control the drive device; and a drive housing configured to receive the drive device, the drive housing comprising:

a longitudinal-axis portion arranged about a longitudinal axis at least substantially perpendicular to an axis of rotation of the drive device, and a front portion surrounding a region of an intersection point of the axis of rotation and the longitudinal axis, the front portion comprising a dome-shaped grip surface, within which the at least one actuating element is arranged on a side facing away from the longitudinal-axis portion relative to a first plane defined perpendicular to the longitudinal axis and including the axis of rotation, wherein the longitudinal-axis portion is configured to receive a rechargeable battery pack, wherein the drive device comprises (i) an electric motor, (ii) an electrical power supply interface configured to connect to the rechargeable battery pack, and (iii) at least one control electronics, wherein the at least one control electronics is located between the electric motor and the electrical power supply interface along the longitudinal axis, wherein a clearance is defined between the at least one actuating element and the electric motor in a top view of the hand-held sanding machine, wherein the dome-shaped grip surface includes a plurality of partial surface areas that terminates the front portion along the longitudinal axis, wherein one partial surface area of the plurality of partial surface areas surrounds the at least one actuating element, and wherein the partial surface areas of the plurality of partial surface areas are arranged at a front angle of between 95° and 110° in relation to one another.

2. The hand-held sanding machine according to claim 1, wherein:

the at least one actuating element is arranged in the one partial surface area of the plurality of partial surface areas, and the one partial surface area is arranged obliquely to the longitudinal axis and to the axis of rotation.

3. The hand-held sanding machine according to claim 1, wherein:

the at least one actuating element and the at least one sanding device are arranged on different sides of a transverse plane, the transverse plane is defined at least substantially perpendicular to the axis of rotation, the front portion has a greatest grip-surface transverse extent in the transverse plane, and the greatest grip-surface transverse extent runs perpendicularly to the axis of rotation and at least substantially perpendicularly to the longitudinal axis.

4. The hand-held sanding machine according to claim 1, wherein a ratio of a maximum grip-surface height of the dome-shaped grip surface parallel to the axis of rotation to an overall height of the drive housing parallel to the maximum grip-surface height is between 0.65 and 0.8.

5. The hand-held sanding machine according to claim 1, wherein:

in a second plane which is perpendicular to the axis of rotation and comprises the longitudinal axis, the drive housing has a first protrusion on a first side and a second protrusion on a second side, and a ratio of a maximum protrusion transverse extent from the first protrusion to the second protrusion relative to a greatest grip-surface transverse extent of the front portion is between 0.75 and 0.9.

6. The hand-held sanding machine according to claim 5, wherein:

the dome-shaped grip surface of the drive housing, proceeding from the front portion in a direction along the longitudinal axis, tapers continuously into a tapering region of the longitudinal-axis portion that is delimited by the first protrusion and the second protrusion, and a ratio of a maximum tapering transverse extent of the tapering region to a greatest grip-surface transverse extent of the front portion is between 0.7 and 0.85.

7. The hand-held sanding machine according to claim 5, wherein:

the dome-shaped grip surface of the drive housing extends from the front portion as far as a third plane, and the third plane is perpendicular to the longitudinal axis and intersects the first protrusion and the second protrusion.

8. The hand-held sanding machine according to claim 5, wherein:

a third plane is perpendicular to the longitudinal axis and intersects the first protrusion and the second protrusion, and the third plane subdivides a maximum longitudinal extent of the drive housing in a ratio of between 0.45 and 0.65.

9. The hand-held sanding machine according to claim 1, wherein:

the drive housing defines a taper at a lower end of the drive housing, the taper faces the at least one sanding device, the taper is concentric to the axis of rotation at a docking interface, and the taper provides a hand placement surface that is arranged around the axis of rotation.

10. A hand-held sanding machine, comprising:

at least one sanding device configured to receive or form a sanding apparatus;

a drive device configured to drive the at least one sanding device;

at least one actuating element configured to control the drive device;

a drive housing configured to receive the drive device, the drive housing comprising:

a longitudinal-axis portion arranged about a housing longitudinal axis at least substantially perpendicular to an axis of rotation of the drive device, and a front portion surrounding a region of an intersection point of the axis of rotation and the housing longitudinal axis, the front portion comprising a dome-shaped grip surface, within which the at least one actuating element is arranged on a side facing away from the longitudinal-axis portion relative to a first plane defined perpendicular to the housing longitudinal axis and including the axis of rotation, a material collection container spaced apart from the drive housing in a second plane perpendicular to the axis of rotation, wherein a container longitudinal axis of the material collection container runs at least substantially parallel to the housing longitudinal axis, wherein the longitudinal-axis portion is configured to receive a rechargeable battery pack, wherein the drive device comprises (i) an electric motor, (ii) an electrical power supply interface configured to connect to the rechargeable battery pack, and (iii) at least one control electronics, wherein the at least one control electronics is located between the electric motor and the electrical power supply interface along the housing longitudinal axis, wherein the dome-shaped grip surface includes a plurality of partial surface areas that terminates the front portion along the housing longitudinal axis, wherein one partial surface area of the plurality of partial surface areas surrounds the at least one actuating element, and wherein the partial surface areas of the plurality of partial surface areas are arranged at a front angle of between 95° and 110° in relation to one another.

11. The hand-held sanding machine according to claim 10, further comprising:

an operating element configured to control the at least one sanding device, wherein the operating element and the material collection container are arranged on different sides of an assembly plane spanned by the axis of rotation and the housing longitudinal axis.

12. The hand-held sanding machine according to claim 10, wherein:

the at least one actuating element is recessed in the one partial surface area of the plurality of partial surface areas, and the electric motor is a brushless DC motor.

13. The hand-held sanding machine according to claim 10, wherein:

the drive device comprises a drive fan configured to cool the electric motor, the drive fan is arranged on the axis of rotation between the electric motor and an interface device, and the interface device is configured to operatively connect the at least one sanding device to the drive device.

14. The hand-held sanding machine according to claim 10, wherein a maximum machine height of the hand-held sanding machine is measured parallel to the axis of rotation and is less than 115 mm.

15. The hand-held sanding machine according to claim 14, wherein the maximum machine height is less than 110 mm.

16. The hand-held sanding machine according to claim 10, wherein a largest transverse extent of the dome-shaped grip surface is between 65 mm and 85 mm.

17. The hand-held sanding machine according to claim 10, further comprising:

a connecting housing unit including an ejection port, wherein the material collection container is fastened to the connecting housing unit.

18. The hand-held sanding machine according to claim 17, wherein:

the material collection container comprises at least one assembly unit, the at least one assembly unit comprises a channel element defining a channel longitudinal axis, the channel element is configured to connect to the ejection port, and the channel longitudinal axis and the container longitudinal axis are arranged in a skewed manner.

19. A hand-held sanding machine, comprising:

at least one sanding device configured to receive or form a sanding apparatus;

a drive device configured to drive the at least one sanding device eccentrically about an axis of rotation of the drive device;

at least one actuating element configured to control the drive device; and a drive housing configured to receive the drive device, the drive housing comprising:

a longitudinal-axis portion arranged about a longitudinal axis at least substantially perpendicular to the axis of rotation of the drive device, and a front portion surrounding a region of an intersection point of the axis of rotation and the longitudinal axis, the front portion comprising a dome-shaped grip surface, within which the at least one actuating element is arranged on a side facing away from the longitudinal-axis portion relative to a first plane defined perpendicular to the longitudinal axis and including the axis of rotation, wherein the longitudinal-axis portion is configured to receive a rechargeable battery pack, wherein the drive device comprises (i) an electric motor, (ii) an electrical power supply interface configured to connect to the rechargeable battery pack, and (iii) at least one control electronics, wherein the at least one control electronics is located between the electric motor and the electrical power supply interface along the longitudinal axis, wherein the at least one actuating element is located below a plane that is perpendicular to the axis of rotation, wherein the plane is located on an end of the axis of rotation, the end facing away from the at least one sanding device, wherein the end of the axis of rotation is a no-drive end of the axis of rotation, wherein the dome-shaped grip surface includes a plurality of partial surface areas that terminates the front portion along the longitudinal axis, wherein one partial surface area of the plurality of partial surface areas surrounds the at least one actuating element, and wherein the partial surface areas of the plurality of partial surface areas are arranged at a front angle of between 95° and 110° in relation to one another.

* * * * *